US008725053B2

(12) United States Patent
Mitsui et al.

(10) Patent No.: US 8,725,053 B2
(45) Date of Patent: May 13, 2014

(54) PRINT CONTROL APPARATUS, PRINT CONTROL SYSTEM, PRINT CONTROL METHOD, AND COMPUTER PROGRAM PRODUCT

(75) Inventors: Ken Mitsui, Kanagawa (JP); Yuu Yamashita, Kanagawa (JP); Hiroaki Suzuki, Chiba (JP)

(73) Assignee: Ricoh Company, Limited, Tokyo (JP)

( * ) Notice: Subject to any disclaimer, the term of this patent is extended or adjusted under 35 U.S.C. 154(b) by 83 days.

(21) Appl. No.: 13/422,141

(22) Filed: Mar. 16, 2012

(65) Prior Publication Data

US 2012/0237245 A1 Sep. 20, 2012

(30) Foreign Application Priority Data

Mar. 17, 2011 (JP) ..... 2011-058860
Mar. 12, 2012 (JP) ..... 2012-054849

(51) Int. Cl.
*G03G 15/20* (2006.01)

(52) U.S. Cl.
USPC ..... 399/341

(58) Field of Classification Search
USPC ..... 399/45, 341, 407
See application file for complete search history.

(56) References Cited

U.S. PATENT DOCUMENTS

2005/0135851 A1* 6/2005 Ng et al. ..... 399/341
2009/0233199 A1 9/2009 Nozaki et al.

FOREIGN PATENT DOCUMENTS

JP 2009-217083 9/2009

* cited by examiner

*Primary Examiner* — David Gray
*Assistant Examiner* — Thomas Giampaolo, II
(74) *Attorney, Agent, or Firm* — Oblon, Spivak, McClelland, Maier & Neustadt, L.L.P.

(57) ABSTRACT

A print control apparatus includes an acquiring unit configured to acquire a glossiness indicating a degree of glossy effect on a recording medium; a first generating unit configured to generate image data based on the glossiness acquired by the acquiring unit; and an output unit configured to output the image data.

16 Claims, 15 Drawing Sheets

FIG.3

10a

| MEDIA NAME | TYPE | SIZE | GLOSSINESS | TRAY NUMBER |
|---|---|---|---|---|
| MEDIUM 1 | PLAIN PAPER | A4 | 0 | 1 |
| MEDIUM 2 | PLAIN PAPER | B5 | 0 | 2 |
| MEDIUM 3 | GLOSSY PAPER | A4 | 250 | 3 |
| MEDIUM 4 | MATTE PAPER | A4 | 10 | 4 |
| MEDIUM 5 | GLOSSY PAPER | B5 | 250 | 5 |
| ... | ... | ... | ... | ... |

FIG.4

10b

| DENSITY VALUE (%) | GLOSSINESS | | | GLOSSY EFFECT | GLOSSER ON/OFF | CLEAR TONER PLATE 1 (PRINTER MACHINE) | CLEAR TONER PLATE 2 (LOW-TEMPERATURE FIXING UNIT) |
|---|---|---|---|---|---|---|---|
| | REPRE-SENTA-TIVE | NUMERICAL RANGE | | | | | |
| 98 | 250 | 248 | 255 | PREMIUM GLOSS, TYPE A | ON | INVERSE MASK A | NO DATA |
| 96 | 245 | 243 | 247 | PREMIUM GLOSS, TYPE B | ON | INVERSE MASK B | NO DATA |
| 94 | 240 | 238 | 242 | PREMIUM GLOSS, TYPE C | ON | INVERSE MASK C | NO DATA |
| 90 | 230 | 228 | 232 | GLOSS, TYPE 1 | OFF | INVERSE MASK 1 | NO DATA |
| 88 | 224 | 222 | 227 | GLOSS, TYPE 2 | OFF | INVERSE MASK 2 | NO DATA |
| 86 | 219 | 217 | 221 | GLOSS, TYPE 3 | OFF | INVERSE MASK 3 | NO DATA |
| 84 | 214 | 212 | 216 | GLOSS, TYPE 4 | OFF | INVERSE MASK 4 | NO DATA |
| 16 | 41 | 39 | 43 | MATT, TYPE 4 | OFF | HALFTONE 4 | NO DATA |
| 14 | 36 | 34 | 38 | MATT, TYPE 3 | OFF | HALFTONE 3 | NO DATA |
| 12 | 31 | 29 | 33 | MATT, TYPE 2 | OFF | HALFTONE 2 | NO DATA |
| 10 | 25 | 23 | 28 | MATT, TYPE 1 | OFF | HALFTONE 1 | NO DATA |
| 6 | 15 | 13 | 17 | PREMIUM MATT, TYPE C | OFF | NO DATA | SOLID |
| 4 | 10 | 8 | 12 | PREMIUM MATT, TYPE B | OFF | NO DATA | SOLID |
| 2 | 5 | 1 | 7 | PREMIUM MATT, TYPE A | OFF | NO DATA | SOLID |
| 0 | 0 | 0 | 0 | NONE | OFF | NO DATA | NO DATA |

PRINT CONTROL APPARATUS, PRINT CONTROL SYSTEM, PRINT CONTROL METHOD, AND COMPUTER PROGRAM PRODUCT

CROSS-REFERENCE TO RELATED APPLICATIONS

The present application claims priority to and incorporates by reference the entire contents of Japanese Patent Application No. 2011-058860 filed in Japan on Mar. 17, 2011 and Japanese Patent Application No. 2012-054849 filed in Japan on Mar. 12, 2012.

BACKGROUND OF THE INVENTION

1. Field of the Invention

The present invention relates to a print control apparatus, a print control system, a print control method, and a computer program product.

2. Description of the Related Art

Conventionally, there is an image forming apparatus on which clear toner that is colorless toner containing no color material and color toners of four colors of CMYK are mounted. A toner image formed with the clear toner is fixed onto paper on which an image has been formed with the color toners, so that visual-tactual effects (referred to as glossy effects) are realized on a surface of the paper. A glossy effect to be realized varies depending on a toner image formed with the clear toner and a fixing manner thereof. For example, there is a glossy effect of giving gloss as described in Japanese Patent Application Laid-open No. 2009-217083. There is also a glossy effect of suppressing gloss on the contrary. Furthermore, there is also a glossy effect that can be realized by performing a post-processing by special post-processors such as a glosser and a low-temperature fixing unit in addition to fixing control.

Note that when a user selects a type of paper, a user expects a glossy effect that the paper has (for example, matte effect if matte paper is selected) on the entire paper. However, there is the problem in that color toner reduces a glossy effect of the paper on a region to which the color toner adheres (hereinafter, referred to as a color toner region). The conventional technique does not take the glossy effect of paper itself into consideration at all and thus fails to solve this problem.

Therefore, there is a need for a print control apparatus, a print control system, a print control method, and a computer program product that make it possible to make a glossy effect on a region to which color toner adheres equivalent to a glossy effect of paper itself.

SUMMARY OF THE INVENTION

It is an object of the present invention to at least partially solve the problems in the conventional technology.

According to an embodiment, there is provided a print control apparatus that includes an acquiring unit configured to acquire a glossiness indicating a degree of glossy effect on a recording medium; a first generating unit configured to generate image data based on the glossiness acquired by the acquiring unit; and an output unit configured to output the image data.

According to another embodiment, there is provided a print control system that includes the print control apparatus according to the above embodiment.

According to still another embodiment, there is provided a print control method that includes acquiring a glossiness indicating a degree of glossy effect on a recording medium; generating image data based on the acquired glossiness; and outputting the image data.

According to still another embodiment, there is provided a computer program product comprising a non-transitory computer readable medium including programmed instructions. The instructions cause a computer included in a print control apparatus to execute acquiring a glossiness indicating a degree of glossy effect on a recording medium; generating image data based on the acquired glossiness; and outputting the image data.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 3 is a view illustrating an example of a media catalog as illustrated in FIG. 2;

FIG. 4 is a view illustrating an example of a glossy effect selection table as illustrated in FIG. 2;

DETAILED DESCRIPTION OF THE PREFERRED EMBODIMENTS

Figure 1:
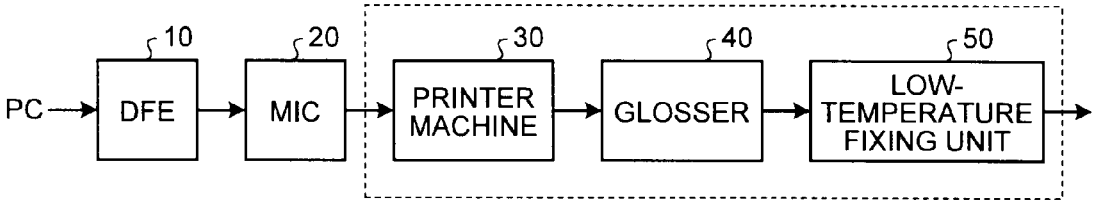
FIG. 1 is a diagram illustrating an example of a configuration of a print control system according to a first embodiment of the present invention.

Hereinafter, embodiments of a print control apparatus, a print control system, a print control method, and a print control program according to the invention will be described in detail with reference to accompanying drawings. It is to be noted that the invention is not limited to the embodiments as illustrated in the drawings.

First Embodiment

At first, a configuration of a print control system according to a first embodiment is described with reference to FIG. 1. In the first embodiment, the print control system is configured by connecting a digital front end (DFE) 10 serving as a printer control device, a mechanism I/F controller (MIC) 20, a printer machine 30 (an image forming apparatus), a glosser 40, and a low-temperature fixing unit 50. The glosser 40 and the low-temperature fixing unit 50 serve as post-processors.

The DFE 10 communicates with the printer machine 30 through the MIC 20 so as to control image formation on the printer machine 30. Furthermore, a personal computer (PC) is connected to the DFE 10. The DFE 10 receives image data from the PC, generates image data used when the printer machine 30 forms toner images corresponding to toners of CMYK and clear toner using the received image data, and transmits the generated image data to the printer machine 30 through the MIC 20.

The printer machine 30 includes at least the toners of CMYK and the transparent clear toner having no color material. The printer machine 30 also includes an image forming unit, an exposing unit, and a fixing unit for each of the toners. The image forming unit includes a photosensitive element, a charging unit, a developing unit, and a photosensitive element cleaner. The printer machine 30 emits light beams from the exposing units so as to form toner images corresponding to the toners on the photosensitive elements in accordance with the image data transmitted from the DFE 10 through the MIC 20. Then, the printer machine 30 transfers the formed toner images onto paper and fixes the toner images by heating and pressurizing at a temperature (normal temperature) in a predetermined range by the fixing units. With this, an image is formed on the paper. Since such a configuration of the printer machine 30 is well-known, details thereof are not described.

The glosser 40 is a machine that re-fixes a toner image having fixed on paper by the printer machine 30 to improve a smoothness of the surface of the toner image on the paper, thereby increasing the glossiness of the surface of the toner image. The glosser 40 is not limited to a special machine. The glosser 40 is controlled to be turned on/off by the DFE 10. When the glosser 40 is turned on, the glosser 40 pressurizes an image formed on paper by the printer machine 30 at a high temperature and a high pressure. With this, all the toners on pixel areas, each having equal to or larger than a predetermined amount of adhered toners, are uniformly compressed over the entire image formed on the paper. Accordingly, the glosser 40 re-fixes the toner image having formed on paper by the printer machine 30 to improve a smoothness of the surface of the toner image on the paper, thereby increasing the glossiness of the surface of the toner image.

The low-temperature fixing unit 50 includes clear toner and a fixing unit for fixing the clear toner. Image data of a clear toner plate (clear toner plane), which will be described later, generated by the DFE 10 for being used by the low-temperature fixing unit 50 is input to the low-temperature fixing unit 50. When the DFE 10 generates the image data of the clear toner plate (clear toner plate data) for being used by the low-temperature fixing unit 50, the low-temperature fixing unit 50 forms a toner image with the clear toner using the image data. Then, the low-temperature fixing unit 50 superimposes the toner image on the paper pressurized by the glosser 40 so as to fix it onto the paper by heating or pressurizing it at a temperature or a pressure that is lower than a normal level by the fixing unit.

Then, image data input from the PC is described. If a user performs a predetermined operation on the PC when an image is output, the PC generates image data with an image processing application that has been previously installed and transmits the image data together with print setting data to the DFE 10 as print data. Note that the print setting data is used when an image of the image data is output. For example, the print setting data includes information for specifying paper to be used and information for specifying a paper tray.

Next, a configuration of the DFE 10 is described. The DFE 10 includes, as a hardware configuration, a controller such as a central processing unit (CPU), a main storage unit such as a read only memory (ROM) and a random access memory (RAM), and an auxiliary storage unit such as a hard disk drive (HDD), and has a hardware configuration using a common computer (any of them are not illustrated). The controller controls the entire apparatus. The main storage unit stores various data and various programs. The auxiliary storage unit stores various data and various programs.

Figure 2:
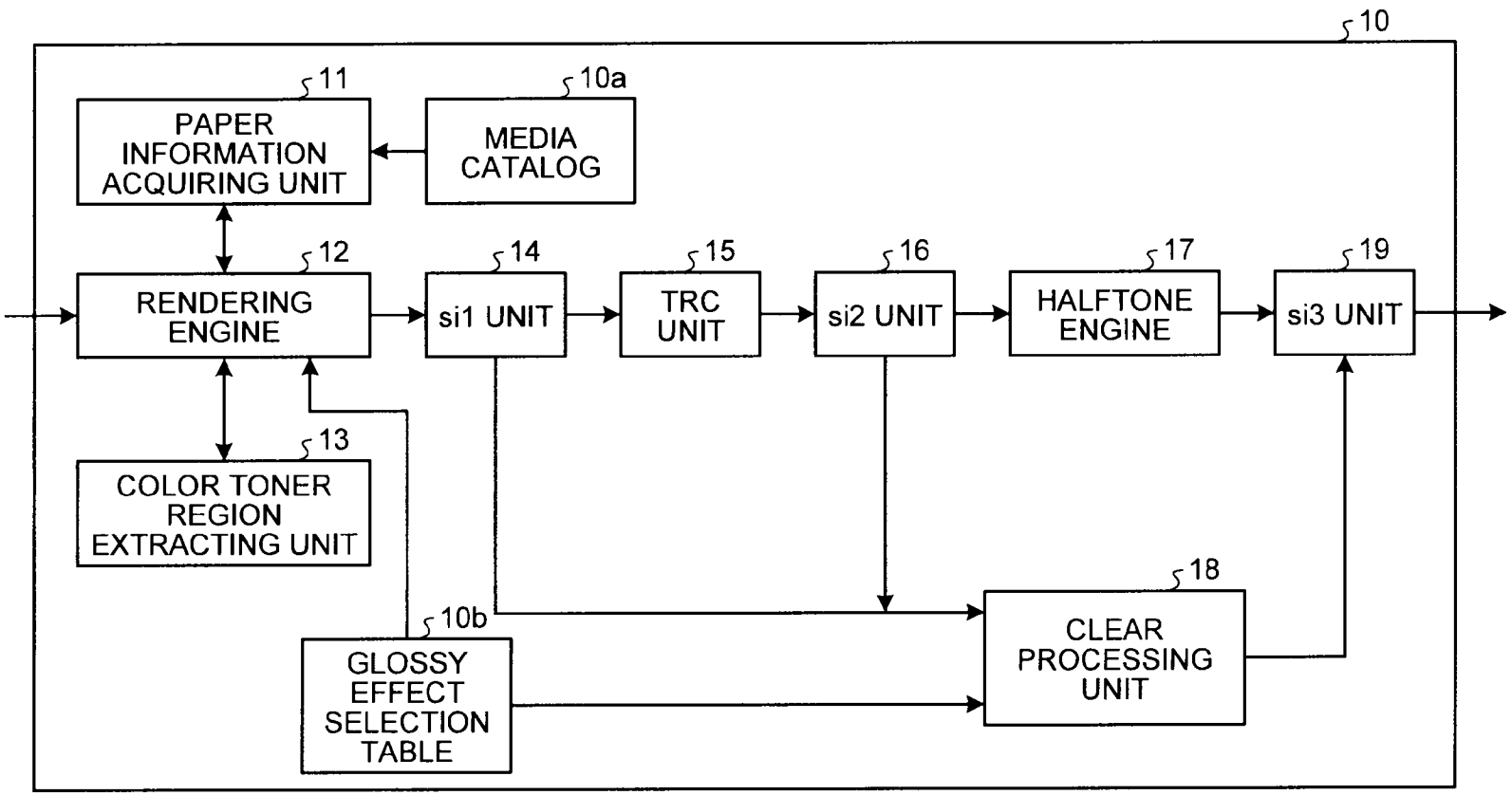
FIG. 2 is a diagram illustrating an example of a functional configuration of a digital front end (DFE) as illustrated in FIG. 1.

As a functional configuration, the DFE 10 includes a paper information acquiring unit 11, a rendering engine 12, a color toner region extracting unit 13, an si1 unit 14, a tone reproduction curve (TRC) unit 15, an si2 unit 16, a halftone engine 17, a clear processing unit 18, an si3 unit 19, a media catalog 10*a*, and a glossy effect selection table 10*b*, as illustrated in FIG. 2. The paper information acquiring unit 11, the rendering engine 12, the color toner region extracting unit 13, the si1 unit 14, the TRC unit 15, the si2 unit 16, the halftone engine 17, the clear processing unit 18, and the si3 unit 19 are realized when the controller of the DFE 10 executes various programs stored in the main storage unit or the auxiliary storage unit.

Each of the si1 unit 14, the si2 unit 16, and the si3 unit 19 has a function of separating image data and a function of integrating image data. Furthermore, the media catalog 10*a* and the glossy effect selection table 10*b* are stored in the auxiliary storage unit, for example.

The paper information acquiring unit 11 determines the paper type of paper as a print medium, and reads out paper information relating to the paper type from the media catalog 10*a*. Furthermore, the paper information acquiring unit 11 outputs the paper information that has been read out from the media catalog 10*a* to the rendering engine 12. Note that the determination of the paper type is not particularly limited and may be performed by various methods. For example, when a paper type is explicitly input (specified) through the PC or the like, the specified paper type may be determined as the paper type of paper as a print medium. Alternatively, when predetermined information that makes it possible to specify a paper type (for example, identification information for identifying a paper tray, which will be described later) is received, the paper type of paper as a print medium may be determined (identified) based on the information. It is to be noted that the paper information acquiring unit 11 corresponds to an acquiring unit.

The media catalog 10*a* is a data table or the like which stores paper information relating to each paper. As illustrated in FIG. 3, the media catalog 10*a* stores paper information in which a media name, a type (plain paper, glossy paper, matte paper, or the like), a size, a glossiness, and a tray number of a paper tray storing each paper are corresponded to one another for each paper. Note that the glossiness is a parameter indicating a degree of gloss that a print surface of paper (special paper) has. For example, glossiness that paper itself has is expressed by a numerical value for each of papers such as "glossy paper" and "matte paper". It is to be noted that in FIG. 3, as a numerical value of the glossiness is higher, a gloss level is increased. The paper trays (not illustrated) are provided on the printer machine 30 and paper of each paper type registered in the media catalog 10*a* is stored in a paper tray of a corresponding tray number. Furthermore, the media name is uniquely given to each medium registered in the media catalog 10*a* so as not to overlap with other names.

A printer driver included in the PC provides a user with a user interface (UI) that makes it possible to specify (select) a paper type to be used for printing with reference to the media catalog 10*a* by using a protocol such as a management information base (MIB). If one media name is specified (selected) from the media catalog 10*a* by a user, the paper information acquiring unit 11 reads out paper information corresponding to the specified media name from the media catalog 10*a* and outputs it to the rendering engine 12. In addition, when a certain paper tray is specified (selected) by a user, the paper information acquiring unit 11 reads out paper information relating to a paper type corresponding to the paper tray from the media catalog 10*a* and outputs it to the rendering engine 12.

In the first embodiment, the DFE 10 itself includes the media catalog 10*a*. However, the invention is not limited thereto and a mode in which the paper information acquiring unit 11 refers to the media catalog 10*a* included in an apparatus other than the DFE 10 may be employed.

Image data transmitted from the PC, a glossiness which is a piece of paper information output from the paper information acquiring unit 11, and color toner region information indicating color toner regions that have been extracted by the color toner region extracting unit 13 are input to the rendering engine 12. The color toner region is a region to which color toner is to adhere on paper (an example of a recording medium). Hereinafter, the paper (an example of a recording medium) is simply referred to as "the paper".

The rendering engine 12 interprets the input image data and converts the image data expressed in a vector format to image data in a raster format. In addition, the rendering engine 12 converts a color space expressed in an RGB format to a color space in a CMYK format. With this, the rendering engine 12 generates pieces of 8-bit image data as color plates (color planes) for CMYK (CMYK color plates) (pieces of 8-bit image data of CMYK color plates (color plate data)). Then, the rendering engine 12 outputs the generated image data to the color toner region extracting unit 13 and the si1 unit 14.

Furthermore, the rendering engine 12 reads out density information (density value) corresponding to a glossiness included in the input paper information from the glossy effect selection table 10*b*. Then, the rendering engine 12 sets the density value that has been read out from the glossy effect selection table 10*b*, which will be described later, as a pixel value for each pixel of color toner regions indicated by the color toner region information input from the color toner region extracting unit 13. With this, the rendering engine 12 generates 8-bit image data as a gloss control plate (gloss control plate data). Then, the rendering engine 12 outputs the image data of the gloss control plate to the si1 unit 14. It is to be noted that the rendering engine 12 corresponds to a gloss control plate generating unit.

The image data of the gloss control plate (gloss control plate data) is image data for identifying a type of a glossy effect as visual and tactual effects to be given to a transfer paper to control to make clear toner adhere in accordance with the glossy effect. The image data is formed by pixel groups like color plates for RGB and CMYK. Each pixel forming the image data of the gloss control plate corresponds to a pixel of the image data (color plate data) of the CMYK color plates. Furthermore, both of the CMYK color plates and the gloss control plate are formed per page. In the embodiment, a density value is expressed by 8 bits. However, an expression manner thereof is not particularly limited and the density value may be expressed by a value of 0 to 255 or may be expressed by percent of 0 to 100%. Alternatively, the density value may be expressed by 16 bits or 32 bits.

The glossy effect selection table 10*b* is a table indicating a correspondence relationship among a glossiness as a glossy effect that paper itself has, a density value of clear toner (clear signal) required for realizing a glossy effect equivalent to the above glossy effect, and a type of the glossy effect. At the same time, the glossy effect selection table 10*b* is a table indicating a correspondence relationship among control information relating to the post-processor for realizing the glossy effect, image data of a clear toner plate to be used in the printer machine 30, and image data of a clear toner plate to be used in the post-processor.

For the post-processors, various configurations can be employed in accordance with a configuration of a print control system. In the first embodiment, the glosser 40 and the low-temperature fixing unit 50 that serve as the post-processors are connected to the printer machine 30. Therefore, the control information relating to the post-processor corresponds to information indicating on/off of the glosser 40. Furthermore, as the image data of the clear toner plate to be used in the post-processor, there is image data of a clear toner plate to be used in the low-temperature fixing unit 50.

FIG. 4 is a view illustrating an example of the glossy effect selection table 10*b*. As illustrated in FIG. 4, each density value and each type of a glossy effect are made to correspond to each range of the glossiness on the glossy effect selection table 10*b*. Furthermore, each type of a glossy effect is made to correspond to each density value.

When a glossiness of the paper information input from the paper information acquiring unit 11 is 250, for example, the rendering engine 12 reads out a density value of 98 corresponding to the glossiness from the glossy effect selection table 10*b* so as to generate image data of a gloss control plate by setting it as a pixel value for each pixel constituting the color toner regions. Furthermore, a type of a glossy effect is identified by the density value set for each pixel of the color toner regions on the clear processing unit 18, which will be described later. It is to be noted that in FIG. 4, the density value is expressed by percent.

In addition, on the glossy effect selection table 10*b* as illustrated in FIG. 4, types of glossy effects relating to presence/absence of gloss are illustrated. There are four types of the glossy effects relating to the presence/absence of gloss in a roughly divided manner. To be more specific, there are types of the glossy effects including "Premium Gloss" (mirror-surface glossy), "Gloss" (solid glossy), "Matte" (halftone matte) and "Premium Matte" (delustered) in descending order of glossiness (glossiness). The Premium Gloss and the Gloss are glossy effects for giving high gloss. On the contrary, the Matte and the Premium Matte are glossy effects for suppressing gloss. In particular, the Premium Matte realizes a glossiness smaller than a glossiness that a normal paper has. Note that the density value and the glossiness for each glossy effect that are registered in the glossy effect selection table 10*b* indicate a glossiness of paper to be used for printing and a glossiness of a glossy effect to be given by the glossy effect. A corresponding glossy effect is selected for each density value registered in the glossy effect selection table 10*b* so that a glossiness equivalent to paper to be used for printing can be given by the glossy effect.

To be more specific, glossy effects for increasing gloss (Premium Gloss and Gloss) are made to correspond to a density value range of 84 to 98 and glossy effects for suppress glossing (Matte and Premium Matte) are made to correspond to a density value range of 2 to 16.

To be further more specific, for example, the Premium Gloss is made to correspond to a density value range of 94 to 98 as the glossy effect. Different types (types A to C) of the Premium Gloss are made to correspond to three density values of 94, 96 and 98, respectively, in the above range. The Gloss is made to correspond to a density value range of 84 to 90. Different types (types 1 to 4) of the Gloss are made to correspond to four density values of 84, 86, 88 and 90, respectively, in the above range. The Matte is made to correspond to a density value range of 10 to 16. Different types (types 1 to 4) of the Matte are made to correspond to four density values of 10, 12, 14 and 16, respectively, in the above range. Furthermore, the Premium Matt is made to correspond to a density value range of 2 to 6. Different types (types A to C) of the Premium Matte are made to correspond to three density values of 2, 4 and 6, respectively, in the above range. Among the different types of the same glossy effect as described above, equations for obtaining image data of the clear toner plates to be used in the printer machine and the low-temperature fixing unit are made different but operations of a printer main body and the post-processors are the same. Furthermore, no glossy effect is given when the density value is 0.

It is to be noted that the correspondence relationship among the control information relating to the post-processor, the image data of the clear toner plate to be used in the printer machine 30, and the image data of the clear toner plate to be used in the post-processor that are stored in the glossy effect selection table 10*b* will be described later.

Returning to FIG. 2, the color toner region extracting unit 13 extracts regions to which color toners adhere (color toner regions) with reference to the pieces of image data of the CMYK color plates that have been generated by the rendering engine 12. Furthermore, the color toner region extracting unit 13 determines whether the size of a pixel group (cluster) constituting each color toner region is equal to or larger than a previously set threshold. If the size of the pixel group is smaller than the threshold, the color toner region extracting unit 13 excludes the group from the color toner regions. Subsequently, the color toner region extracting unit 13 generates color toner region information indicating positions of the color toner regions in a page, that is, positions of the pixel groups constituting the color toner regions, and outputs the generated color toner region information to the rendering engine 12. It is to be noted that the color toner region extracting unit 13 corresponds to an extracting unit.

Figure 5A:
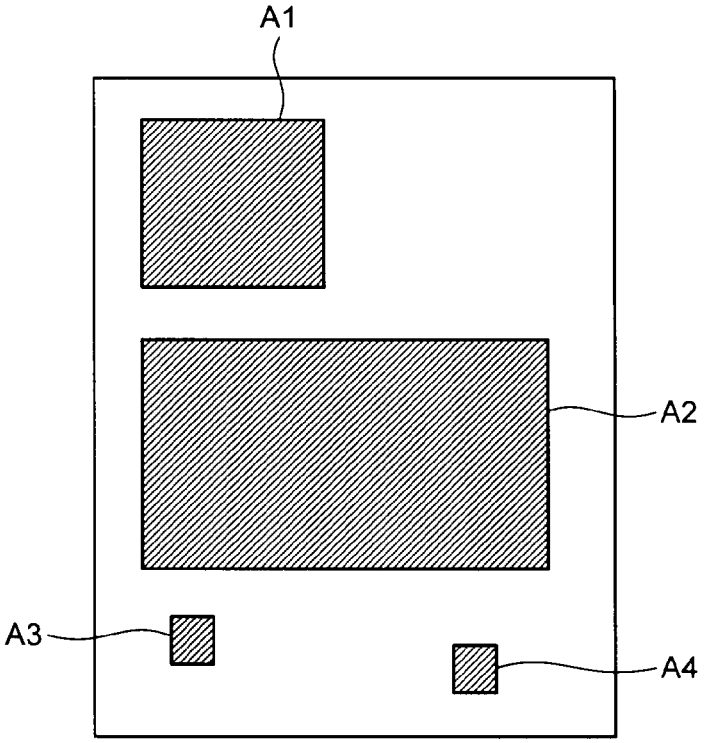
FIGS. 5A and 5B are views for explaining an operation of a color toner region extracting unit as illustrated in FIG. 2.
Figure 5B:
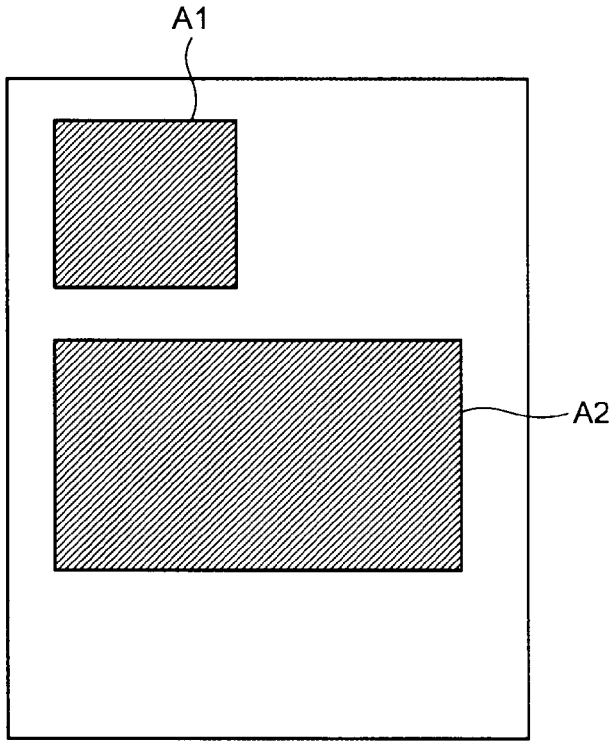

Hereinafter, an operation of the color toner region extracting unit 13 is described with reference to FIGS. 5A and 5B. FIGS. 5A and 5B are views for explaining the operation of the color toner region extracting unit 13. The color toner region extracting unit 13 determines whether color toner adheres for each pixel of image data constituting the CMYK color plates, at first. Then, as illustrated in FIG. 5A, the color toner region extracting unit 13 extracts regions each of which is formed by a group of pixels to which the color toner adheres as color toner regions. In FIG. 5A, hatched regions A1 to A4 correspond to color toner regions to which any of color toners of CMYK adheres.

Subsequently, the color toner region extracting unit 13 compares the size of the pixel group constituting the color toner region with the predetermined threshold for each of the extracted regions A1, A2, A3 and A4. Then, the color toner region extracting unit 13 excludes regions each having a size of the pixel group smaller than the threshold from the color toner regions. In FIG. 5B, the regions A3 and A4 are determined to be smaller than the threshold among the regions A1 to A4 as illustrated in FIG. 5A. The regions A1 and A2 each having a size of equal to or larger than the threshold correspond to the color toner regions. A possibility that a user specifies a glossy effect for a small region as a pixel group having a size smaller than the threshold is lower. Therefore, such a region is excluded from the color toner regions so as to make processing smooth. It is to be noted that a value set as the threshold is not particularly limited. For example, the number of pixels forming one color toner region can be set to be equal to or larger than 300.

Returning to FIG. 2, the si1 unit 14 outputs the pieces of image data of the CMYK color plates to the TRC unit 15, and outputs the image data of the gloss control plate to the clear processing unit 18. The pieces of image data of the CMYK color plates are input to the TRC unit 15 through the si1 unit 14. Gamma correction with a gamma curve of a one-dimensional lookup table (1D_LUT) that is generated by calibration is performed on the input pieces of image data of the CMYK color plates by the TRC unit 15.

The si2 unit 16 outputs the pieces of 8-bit image data of the CMYK color plates on which the gamma correction has been performed by the TRC unit 15 to the clear processing unit 18 as data for generating an inverse mask. The pieces of image data of the CMYK color plates after the gamma correction are input to the halftone engine 17 through the si2 unit 16. The halftone engine 17 performs halftone processing of converting a data format of the input pieces of image data of the CMYK color plates to a data format of pieces of 2-bit image data of the CMYK color plates in order to output the image data to the printer machine 30. Then, the halftone engine 17 outputs the pieces of 2-bit image data of the CMYK color plates after the halftone processing.

The 8-bit image data of the gloss control plate that has been converted by the rendering engine 12 is input to the clear processing unit 18 through the si1 unit 14. Furthermore, the pieces of 8-bit image data of the CMYK color plates on which the TRC unit 15 has performed the gamma correction are input to the clear processing unit 18 through the si2 unit 16.

The clear processing unit 18 determines a glossy effect corresponding to each pixel value (density value) set for each pixel of the input image data of the gloss control plate with reference to the above-mentioned glossy effect selection table 10*b* (see FIG. 4). Then, the clear processing unit 18 determines on/off of the glosser 40 in accordance with the determination. Furthermore, the clear processing unit 18 appropriately generates an inverse mask or a solid mask using the input pieces of 8-bit image data of the CMYK color plates so as to appropriately generate 2-bit image data of a clear toner plate for causing the clear toner to adhere. Then, in accordance with a result of the determination of the glossy effect, the clear processing unit 18 appropriately generates and outputs image data of a clear toner plate (clear toner plate data) to be used in the printer machine 30 and image data of a clear toner plate (clear toner plate data) to be used in the low-temperature fixing unit 50, and outputs on/off information indicating on/off of the glosser 40. It is to be noted that the clear processing unit 18 corresponds to a clear toner plate generating unit and a post-processing control unit.

The inverse mask is a mask for making a total adhesion amount of the toners of CMYK and the clear toner on each of pixels constituting regions as targets on which a glossy effect is given uniform. To be more specific, image data obtained by inverting all the density values indicated by the pixels constituting the target regions on the image data of the CMYK color plates corresponds to the inverse mask. The inverse mask is expressed by the following Equation (1), for example.

$$Clr=100-(C+M+Y+K) \quad (1)$$

if $Clr<0$, then $Clr=0$.

In Equation (1), each of Clr, C, M, Y, and K expresses a density rate calculated from a density value on each pixel for each of the clear toner and the toners of C, M, Y, and K. With Equation (1), a total adhesion amount obtained by adding an adhesion amount of the clear toner to a total adhesion amount of the toners of C, M, Y, and K is made to be 100% for all the pixels constituting the regions as the targets on which a glossy effect is given. It is to be noted that when the total adhesion amount of the toners of C, M, Y, and K is equal to or larger than 100%, the clear toner does not adhere and a density rate thereof is set to 0%. This is because a portion on which the total adhesion amount of the toners of C, M, Y, and K is equal to or larger than 100% is made smooth by a fixing processing. If the total adhesion amount on each of all the pixels constituting the regions as the targets on which a glossy effect is given is made to be equal to or larger than 100% in the this manner, surface irregularities due to a difference in the total adhesion amount of the toners on the target regions are eliminated. As a result, gloss with regular reflection of light is generated. Note that there are inverse masks obtained by methods other than Equation (1) and there may be a plurality of types of inverse masks.

Furthermore, the solid mask is a mask for causing the clear toner to uniformly adhere to each of pixels constituting the regions as the targets on which a glossy effect is given. To be more specific, the solid mask is expressed by the following Equation (2), for example.

$$Clr=100 \quad (2)$$

It is to be noted that there may be a pixel to which a density rate that is not 100% is related among the pixels as the targets on which a glossy effect is given and there may be a plurality of patterns of solid masks.

As illustrated in FIG. 4, in the glossy effect selection table 10*b*, the on/off information indicating on/off of the glosser 40 and contents of the image data of a clear toner plate 1 to be used in the printer machine 30 and the image data of a clear toner plate 2 to be used in the low-temperature fixing unit 50 are indicated in accordance with each glossy effect. For example, when the glossy effect is the Premium Gloss, the glossy effect selection table 10*b* indicates that the glosser 40 is made on, the image data of the clear toner plate 1 to be used in the printer machine 30 is the inverse mask, and the image data of the clear toner plate 2 to be used in the low-temperature fixing unit 50 is not required (no data). It is to be noted that the inverse masks A to C are obtained by different equations based on Equation (1), for example.

Furthermore, when the glossy effect is the Gloss, the glossy effect selection table 10*b* indicates that the glosser 40 is made off, the image data of the clear toner plate 1 to be used in the printer machine 30 is the inverse mask, and the image data of the clear toner plate 2 to be used in the low-temperature fixing unit 50 is not required. It is to be noted that the inverse masks 1 to 4 are obtained by different equations based on Equation (1), for example.

Furthermore, when the glossy effect is the Matte, the glossy effect selection table 10*b* indicates that the glosser 40 is made off, the image data of the clear toner plate 1 to be used in the printer machine 30 is the halftone, and the image data of the clear toner plate 2 to be used in the low-temperature fixing unit 50 is not required. In addition, when the glossy effect is the Premium Matte, the glossy effect selection table 10*b* indicates that the glosser 40 is made off, there is no image data of the clear toner plate 1 to be used in the printer machine 30, and the image data of the clear toner plate 2 to be used in the low-temperature fixing unit 50 is the solid mask. It is to be noted that the solid mask is obtained by Equation (2), for example.

The clear processing unit 18 determines a glossy effect from a density value set as a pixel value for each pixel of the image data of the gloss control plate with reference to the above-mentioned glossy effect selection table 10*b*. In addition, the clear processing unit 18 determines on/off of the glosser 40 and determines which types of image data of clear toner plates are to be used in the printer machine 30 and the low-temperature fixing unit 50. It is to be noted that the clear processing unit 18 performs the determination of on/off of the glosser 40 per page. In addition, as described above, in accordance with the result of the determination, the clear processing unit 18 appropriately generates and outputs image data of the clear toner plates, and outputs the on/off information of the glosser 40.

The si3 unit 19 integrates the pieces of 2-bit image data of the CMYK color plates after the halftone processing and the pieces of 2-bit image data of the clear toner plates that have been generated by the clear processing unit 18, and outputs the integrated image data to the MIC 20. It is to be noted that the si3 unit 19 corresponds to an output unit.

Note that there is a case where the clear processing unit 18 does not generate at least one of the image data of the clear toner plate to be used in the printer machine 30 and the image data of the clear toner plate to be used in the low-temperature fixing unit 50. Therefore, the image data of the clear toner plate that has been generated by the clear processing unit 18 is integrated by the si3 unit 19. When both of pieces of the image data of the clear toner plates are not generated by the clear processing unit 18, image data obtained by integrating the pieces of 2-bit image data of the CMYK color plates is output from the si3 unit 19. As a result, four to six pieces of 2-bit image data (image planes) are transmitted from the DFE 10 to the MIC 20. Furthermore, the si3 unit 19 also outputs the on/off information of the glosser 40 that has been output from the clear processing unit 18 to the MIC 20.

Figure 6:
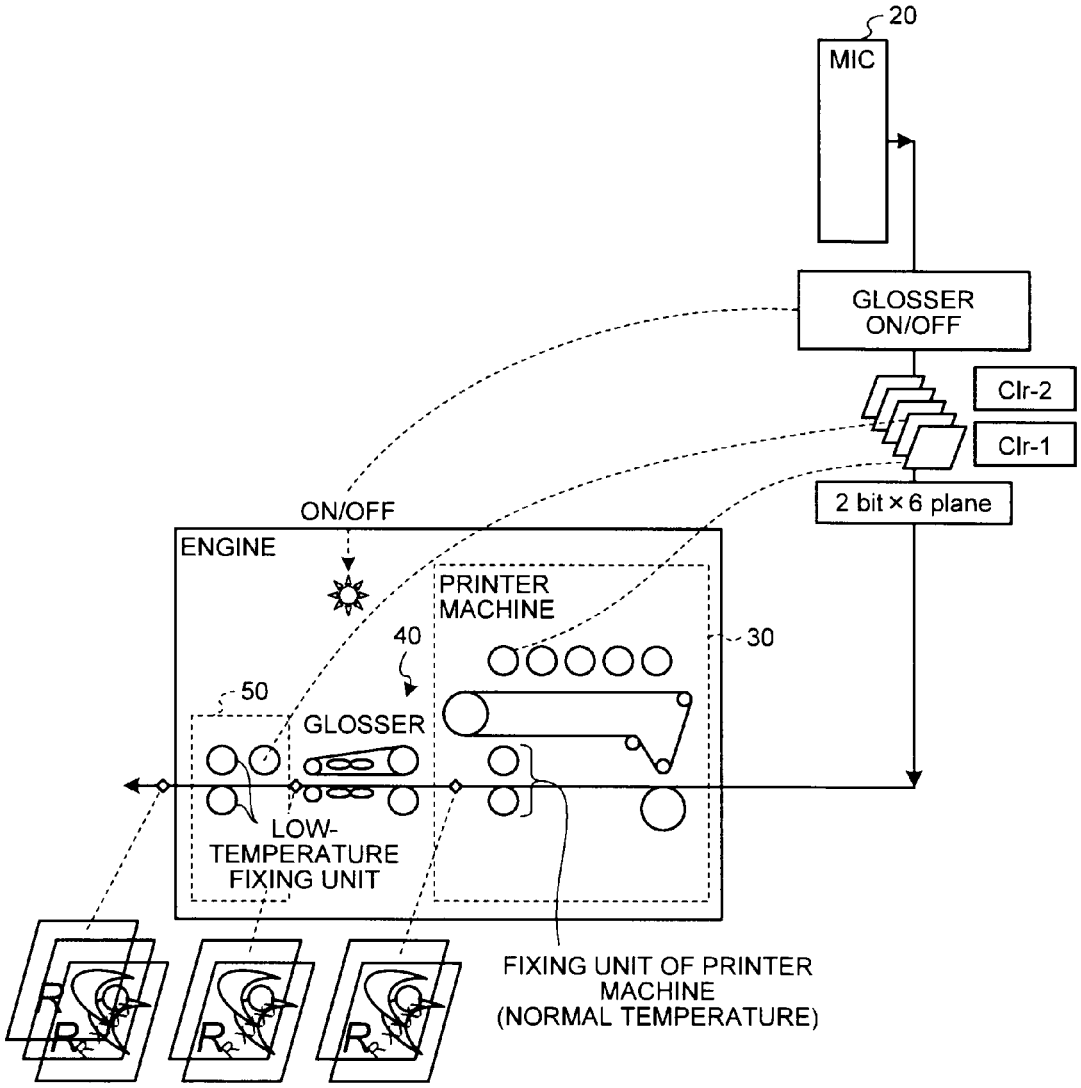
FIG. 6 is a view conceptually illustrating a configuration of a mechanism I/F controller (MIC) as illustrated in FIG. 1.

As illustrated in FIG. 6, the MIC 20 outputs the pieces of image data of the CMYK color plates among the image data output from the DFE 10 to the printer machine 30. When there is the image data of the clear toner plate to be used in the printer machine 30, the MIC 20 also outputs the image data to the printer machine 30 and turns the glosser 40 on/off using the on/off information output from the DFE 10. Furthermore, when there is the image data of the clear toner plate to be used in the low-temperature fixing unit 50, the MIC 20 also outputs the image data to the low-temperature fixing unit 50. The glosser 40 may switch between a path on which fixing is performed and a path on which fixing is not performed based on the on/off information. The low-temperature fixing unit 50 may switch between on and off based on the presence or absence of the image data of the clear toner plate or may switch between paths in the same manner as in the glosser 40.

Figure 7:
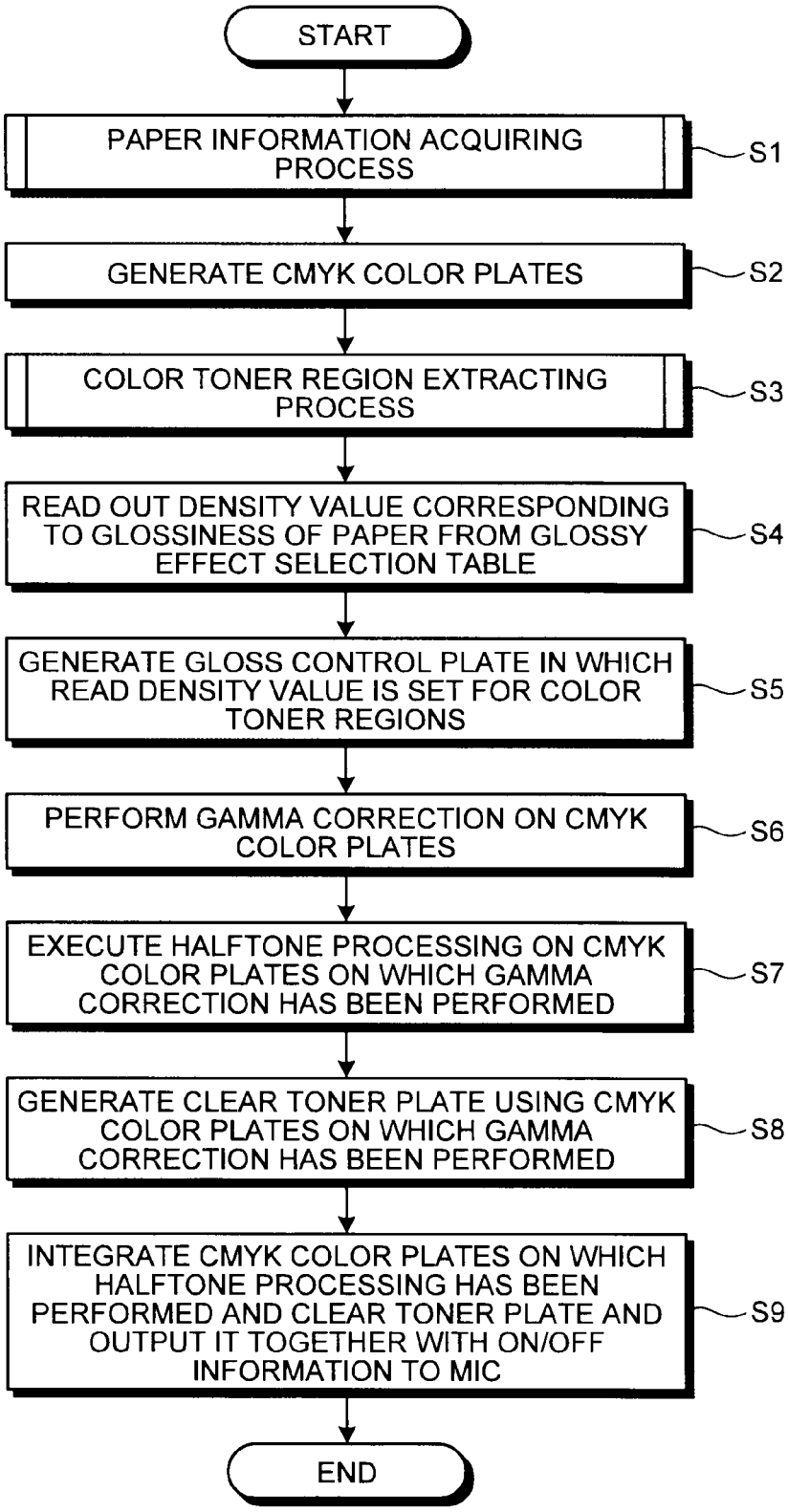
FIG. 7 is a flowchart illustrating procedures of glossy effect control process that is performed by the print control system according to the first embodiment.

Next, procedures of glossy effect control process that is performed by the print control system according to the first embodiment is described with reference to FIG. 7 to FIG. 9. FIG. 7 is a flowchart illustrating the procedures of the glossy effect control process that is performed by the DFE 10 according to the first embodiment.

At first, if print data is input from the PC, the paper information acquiring unit 11 performs paper information acquiring process based on the print data (Step S1).

Figure 8:
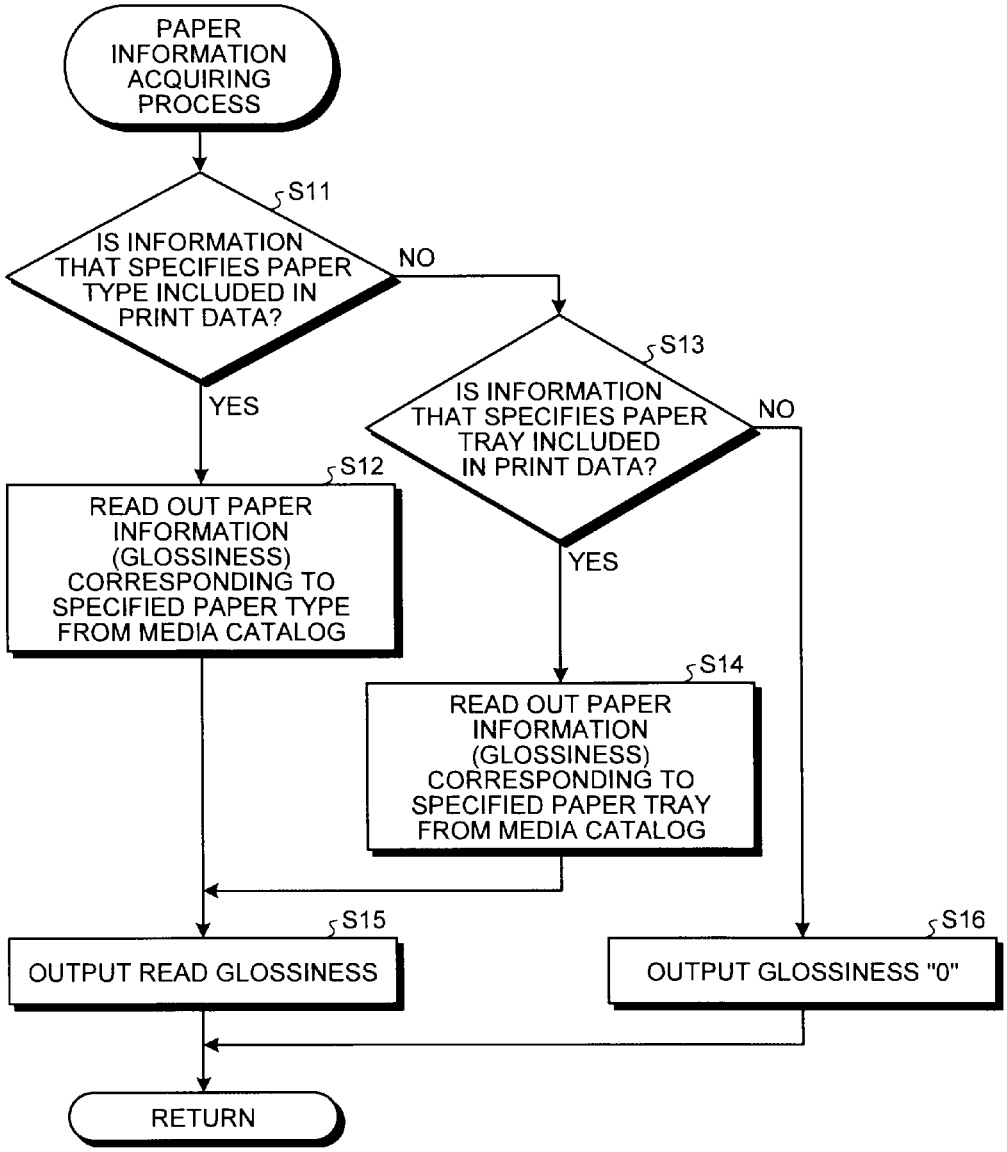
FIG. 8 is a flowchart illustrating procedures of paper information acquiring process as illustrated in FIG. 7.

FIG. 8 is a flowchart illustrating procedures of the paper information acquiring process at Step S1. The paper information acquiring unit 11 determines whether information for specifying a paper type is included in the print data input from the PC (Step S11). When the paper information acquiring unit 11 determines that the information for specifying a paper type is included in the print data (Yes at Step S11), the paper information acquiring unit 11 reads out paper information (glossiness) corresponding to the specified paper type from the media catalog 10*a* (Step S12), and the process proceeds to Step S15.

On the other hand, when the paper information acquiring unit 11 determines that the information for specifying a paper type is not included in the print data at Step S11 (No at Step S11), the paper information acquiring unit 11 determines whether information for specifying a paper tray is included in the input print data (Step S13). When the paper information acquiring unit 11 determines the information for specifying a paper tray is included in the input print data (Yes at Step S13), the paper information acquiring unit 11 reads out paper information (glossiness) corresponding to the specified paper tray from the media catalog 10*a* (Step S14), and the process proceeds to Step S15. On the other hand, when the paper information acquiring unit 11 determines that the information for specifying a paper tray is not included in the input print data (No at Step S13), the paper information acquiring unit 11 outputs paper information including a glossiness of 0 to the rendering engine 12 (Step S16), and the process proceeds to Step S2 in FIG. 7.

At Step S15, the paper information acquiring unit 11 outputs the paper information that has been read out at Step S12 or S14 to the rendering engine 12 (Step S15), and the process proceeds to Step S2 in FIG. 7.

Returning to FIG. 7, if the rendering engine 12 receives input of image data included in the print data, the rendering engine 12 generates pieces of 8-bit image data of CMYK color plates from the image data and outputs the generated image data to the si1 unit 14 and the color toner region extracting unit 13 (Step S2). Subsequently, the color toner region extracting unit 13 performs color toner region extracting process of extracting color toner regions from the pieces of image data of the CMYK color plates that have been generated at Step S2 (Step S3).

Figure 9:
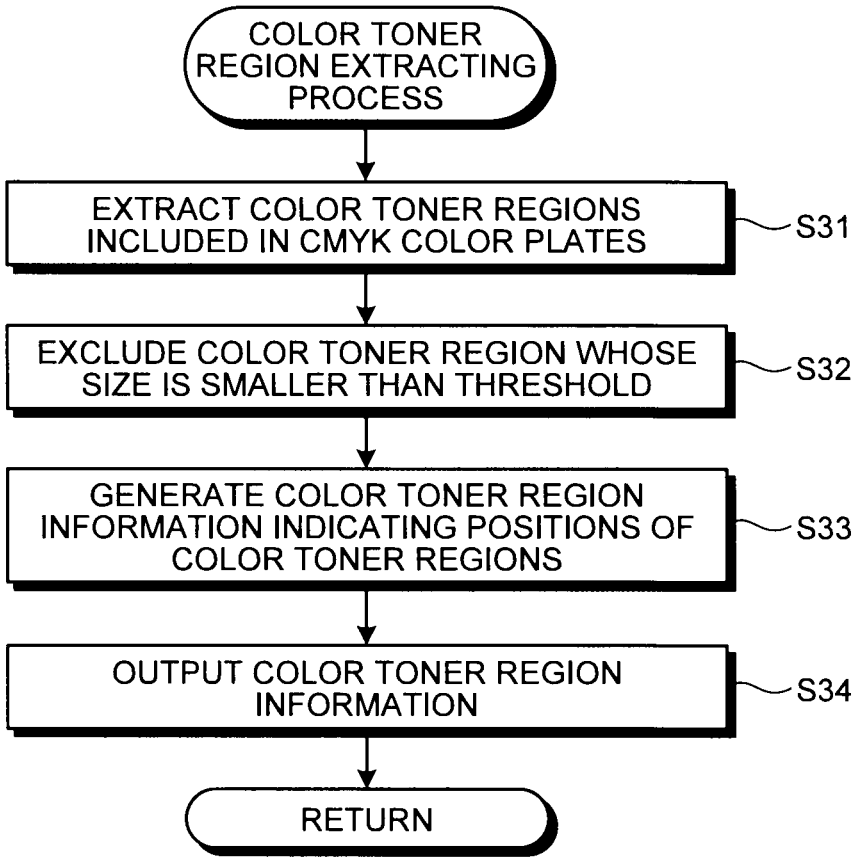
FIG. 9 is a flowchart illustrating procedures of color toner region extracting process as illustrated in FIG. 7.

FIG. 9 is a flowchart illustrating procedures of the color toner region extracting process at Step S3. At first, the color toner region extracting unit 13 extracts color toner regions included in the pieces of image data of the CMYK color plates with reference to the image data of the CMYK color plates (Step S31). Then, the color toner region extracting unit 13 compares the size of each color toner region that has been extracted at Step S31 with a predetermined threshold and excludes a region whose size is determined to be smaller than the threshold from the color toner regions (Step S32).

Subsequently, the color toner region extracting unit 13 generates color toner region information indicating positions of the color toner regions in a page of the image data, that is, positions of pixel groups constituting the color toner regions, for the color toner regions whose sizes are determined to be equal to or larger than the threshold as a processing result of Step S32 (Step S33). Then, the color toner region extracting unit 13 outputs the color toner region information generated at Step S33 to the rendering engine 12 (Step S34), and the process proceeds to Step S4 in FIG. 7.

Returning to FIG. 7, if the rendering engine 12 receives input of the color toner region information from the color toner region extracting unit 13, the rendering engine 12 reads out a density value corresponding to the glossiness included in the paper information acquired in the paper information acquiring process at Step S1 from the glossy effect selection table 10*b* (Step S4). Subsequently, the rendering engine 12 generates 8-bit image data of the gloss control plate in which the density value read out at Step S4 is set as a pixel value for each pixel of the color toner regions indicated by the color toner region information and outputs the generated image data to the si1 unit 14 (Step S5).

If the TRC unit 15 receives the pieces of 8-bit image data of the CMYK color plates through the si1 unit 14, the TRC unit 15 performs gamma correction with a gamma curve of 1D_LUT that is generated by calibration on the pieces of 8-bit image data of the CMYK color plates and outputs them to the si2 unit 16 (Step S6).

If the halftone engine 17 receives the pieces of image data of the CMYK color plates after the gamma correction through the si2 unit 16, the halftone engine 17 performs halftone processing of converting a data format of the pieces of 8-bit image data of the CMYK color plates to a data format of pieces of 2-bit image data of the CMYK color plates in order to output the image data to the printer machine 30 so as to acquire the pieces of 2-bit image data of the CMYK color plates after the halftone processing (Step S7).

Furthermore, the clear processing unit 18 determines a glossy effect corresponding to the pixel value (density value) set for each pixel of the input image data of the gloss control plate with reference to the above-mentioned glossy effect selection table 10*b*. The clear processing unit 18 makes such determination for all the pixels constituting the image data of the gloss control plate. It is to be noted that on the image data of the gloss control plate, since all the pixels constituting regions on which a glossy effect is given basically have the same density value, the same glossy effect is determined to be given to the pixels for which the same density value has been set. In this manner, the clear processing unit 18 determines regions (color toner regions) on which a glossy effect is given and a type of the glossy effect to be given to the regions. Then, the clear processing unit 18 determines on/off of the glosser 40 in accordance with the determination of the regions and the type of the glossy effect, and appropriately generates 2-bit image data of the clear toner plate for causing the clear toner to adhere by appropriately using the pieces of 8-bit image data of the CMYK color plates after the gamma correction (Step S8).

Then, the si3 unit 19 integrates the pieces of 2-bit image data of the CMYK color plates after the halftone processing that have been obtained at Step S7 and the 2-bit image data of the clear toner plate that has been appropriately generated at Step S8, and outputs the integrated image data and the on/off information indicating on/off of the glosser 40 that has been determined at Step S8 to the MIC 20 (Step S9). Note that when the image data of the clear toner plate is not generated at Step S8, only the pieces of 2-bit image data of the CMYK color plates after the halftone processing that have been obtained at Step S7 are integrated and the integrated image data is output to the MIC 20 at Step S9.

Then, specific examples in accordance with types of the glossy effect are described. Each type of the Premium Gloss and the Gloss for giving gloss and the Matte and the Premium Matte for suppressing gloss is described in detail. Furthermore, a case where a glossy effect of the same type is specified in one page is described.

At Step S8, the clear processing unit 18 identifies a glossy effect corresponding to each pixel value (density value) set for each pixel of the 8-bit image data of the gloss control plate from the glossy effect selection table 10*b* as illustrated in FIG. 4. For example, a glossy effect corresponding to each pixel having a density value of 94 to 98 is determined to be the Premium Gloss. In this case, the clear processing unit 18 further generates the inverse mask with Equation (1), for example, by using the image data of the gloss control plate on each image data of the CMYK color plates after the gamma correction. The inverse mask corresponds to image data of a clear toner plate to be used in the printer machine 30. It is to be noted that since image data of a clear toner plate is not used in the low-temperature fixing unit 50, the clear processing unit 18 does not generate the image data of the clear toner plate to be used in the low-temperature fixing unit 50.

Then, at Step S9, the si3 unit 19 integrates the image data of the clear toner plate to be used in the printer machine 30 and the pieces of 2-bit image data of the CMYK color plates after the halftone processing that have been obtained at Step S7, and outputs the integrated image data and the on/off information indicating on of the glosser 40 to the MIC 20.

The MIC 20 outputs the pieces of image data of the CMYK color plates and the image data of the clear toner plate to be used in the printer machine 30 that have been output from the DFE 10 to the printer machine 30 and turns the glosser 40 on using the on/off information output from the DFE 10. The printer machine 30 emits light beams from the exposing units so as to form toner images corresponding to the respective toners on the photosensitive elements using the pieces of image data of the CMYK color plates and the image data of the clear toner plate that have been output from the MIC 20. Then, the printer machine 30 transfers the toner images onto paper and fixes them by heating and pressurizing them at a normal temperature. With this, the clear toner and the toners of the CMYK color plates adhere to the paper so as to form an image. Thereafter, the glosser 40 re-fixes the paper. Since image data of a clear toner plate is not output to the low-temperature fixing unit 50, the clear toner does not adhere to the paper on the low-temperature fixing unit 50 and the paper is discharged. In the first embodiment, the paper, on which an image is formed, is an example of a recording medium. In other words, the recording medium on which an image is formed includes paper and a medium made of other material.

As a result, a total adhesion amount of the toners of CMYK and the clear toner is uniformly compressed on the entire region defined by the image data. Therefore, high gloss is obtained on a surface of the region. Furthermore, since the clear toner adheres to the color toner regions defined by the gloss control plate, gloss equivalent to that of paper is obtained on the surfaces of the color toner regions. With this, texture (gloss) of paper (color toner regions) that is changed with adhesion of the color toners can be kept to be equivalent to texture on regions other than the color toner regions.

Furthermore, the clear processing unit 18 determines that a glossy effect corresponding to each pixel having a density value of 84 to 90, for example, is the Matte at Step S8. In particular, a pixel having a density value of 90 is determined to be the Gloss, type 1. In this case, the clear processing unit 18 generates an inverse mask 1 using image data corresponding to the regions on each image data of the CMYK color plates after the gamma correction. The inverse mask 1 corresponds to image data of a clear toner plate to be used in the printer machine 30. It is to be noted that since image data of a clear toner plate is not used for the regions on the low-temperature fixing unit 50, the DFE 10 does not generate the image data of the clear toner plate to be used in the low-temperature fixing unit 50.

Then, at Step S9, the si3 unit 19 integrates the image data of the clear toner plate to be used in the printer machine 30 and the pieces of 2-bit image data of the CMYK color plates after the halftone processing that have been obtained at Step S7, and outputs the integrated image data and the on/off information indicating off of the glosser 40 to the MIC 20.

The MIC 20 outputs the pieces of image data of the CMYK color plates and the image data of the clear toner plate to be used in the printer machine 30 that have been output from the DFE 10 to the printer machine 30 and turns the glosser 40 off using the on/off information output from the DFE 10. The printer machine 30 forms an image to which the toners of CMYK and the clear toner adhere on paper by using the pieces of image data of the CMYK color plates and the image data of the clear toner plate to be used in the printer machine 30 that have been output from the MIC 20. Since the glosser 40 is turned off, the paper is not pressurized at a high temperature and a high pressure thereafter. Furthermore, since image data of a clear toner plate is not output to the low-temperature fixing unit 50, the clear toner does not adhere to the paper on the low-temperature fixing unit 50 and the paper is discharged.

As a result, a total adhesion amount of the toners of CMYK and the clear toner is made relatively uniform on regions for which the Gloss has been specified as a glossy effect. Therefore, slightly high gloss is obtained on surfaces of the regions. Furthermore, since the clear toner adheres to the color toner regions defined by the gloss control plate, gloss equivalent to that of paper used is obtained on the surfaces of the color toner regions. With this, texture (gloss) of paper (color toner regions) that is changed with adhesion of the color toners can be kept to be equivalent to texture on regions other than the color toner regions.

Furthermore, the clear processing unit 18 determines that a glossy effect corresponding to each pixel having a density value of 10 to 16, for example, is the Matte at Step S8. In this case, the clear processing unit 18 generates image data indicating halftone as image data of a clear toner plate to be used in the printer machine 30. It is to be noted that since image data of a clear toner plate is not used for the regions on the low-temperature fixing unit 50, the DFE 10 does not generate the image data of the clear toner plate to be used in the low-temperature fixing unit 50.

Then, at Step S9, the DFE 10 integrates the image data of the clear toner plate to be used in the printer machine 30 and the pieces of 2-bit image data of the CMYK color plates after the halftone processing that have been obtained at Step S7, and outputs the integrated image data and the on/off information indicating off of the glosser 40 to the MIC 20.

The MIC 20 outputs the pieces of image data of the CMYK color plates and the image data of the clear toner plate to be used in the printer machine 30 that have been output from the DFE 10 to the printer machine 30 and turns the glosser 40 off using the on/off information output from the DFE 10. The printer machine 30 forms an image to which the toners of CMYK and the clear toner adhere on paper by using the pieces of image data of the CMYK color plates and the image data of the clear toner plate that have been output from the MIC 20. Since the glosser 40 is turned off, the paper is not pressurized at a high temperature and a high pressure thereafter. Furthermore, since image data of a clear toner plate is not output to the low-temperature fixing unit 50, the clear toner does not adhere to the paper on the low-temperature fixing unit 50 and the paper is discharged.

As a result, halftone is given to the regions for which the Matte has been specified as a glossy effect with the clear toner. Therefore, surface irregularities are generated so that gloss on the surfaces of the regions is slightly suppressed. Furthermore, the clear toner adheres to the color toner regions defined by the gloss control plate, whereby gloss equivalent to that of paper used is obtained on the surfaces of the color toner regions. With this, texture (gloss) of paper (color toner regions) that is changed with adhesion of the color toners can be kept to be equivalent to texture on regions other than the color toner regions.

Furthermore, the clear processing unit 18 determines that a glossy effect corresponding to each pixel having a density value of 2 to 6, for example, is the Premium Matte at Step S8. In this case, the clear processing unit 18 does not generate image data of a clear toner plate to be used in the printer machine 30 and generates a solid mask as image data of a clear toner plate to be used in the low-temperature fixing unit 50.

Then, at Step S9, the DFE 10 integrates the image data of the clear toner plate to be used in the low-temperature fixing unit 50 and the pieces of 2-bit image data of the CMYK color plates after the halftone processing that have been obtained at Step S7, and outputs the integrated image data and the on/off information indicating off of the glosser 40 to the MIC 20.

The MIC 20 outputs the pieces of image data of the CMYK color plates among the image data output from the DFE 10 to the printer machine 30 and the image data of the clear toner plate to be used in the low-temperature fixing unit 50 among the image data output from the DFE 10 to the low-temperature fixing unit 50. In addition, the MIC 20 turns the glosser 40 off using the on/off information output from the DFE 10. The printer machine 30 forms an image to which the toners of CMYK adhere on paper using the pieces of image data of the CMYK color plates that have been output from the MIC 20. Since the glosser 40 is turned off, the paper is not pressurized at a high temperature and a high pressure thereafter.

The low-temperature fixing unit 50 forms a toner image with the clear toner using the image data of the clear toner plate that has been output from the MIC 20. Then, the low-temperature fixing unit 50 superimposes the toner image on the paper that has passed through the glosser 40 so as to fix it onto the paper by heating and pressurizing at a low temperature.

As a result, surface irregularities are generated on the regions for which the Premium Matte has been specified as a glossy effect with the adhesion of the clear toner with the solid mask. Therefore, gloss on the surfaces of the regions is suppressed. Furthermore, since the clear toner adheres to the color toner regions defined by the gloss control plate, gloss equivalent to that of paper used is obtained on the surfaces of the color toner regions. With this, texture (gloss) of paper (color toner regions) that is changed with adhesion of the color toners can be kept to be equivalent to texture on regions other than the color toner regions.

As described above, according to the first embodiment, the DFE 10 acquires a glossiness of paper to be used and appropriately generates image data of a clear toner plate for causing clear toner to adhere that makes it possible to give a glossy effect that is equivalent to a glossiness of the paper to be used to color toner regions on a paper surface to which color toners adhere in accordance with presence or absence and types of post-processors such as the glosser 40 and the low-temperature fixing unit 50 that are provided at subsequent stages of the printer machine 30. Then, the DFE 10 outputs the generated image data of the clear toner plate and controls the post-processors in accordance with a glossy effect to be given. With this, a glossy effect for providing a glossiness equivalent to the glossiness of the paper can be given to the color toner regions. Therefore, a glossy effect obtained on the color toner regions can be made equivalent to a glossy effect of the paper itself. Furthermore, this makes it possible to perform printing in a state where the glossy effect of the paper itself is kept, thereby providing a printed matter with a glossy effect expected by a user.

It is to be noted that the invention is not limited to the first embodiment as it is and can be embodied by varying constituent components in a range without departing from a scope of the invention in an execution stage thereof. In addition, various inventions can be made by appropriately combining a plurality of constituent components disclosed in the first embodiment. For example, several constituent components may be eliminated from all the constituent components as described in the first embodiment. Furthermore, various variations as will be described below can be made.

For example, in the first embodiment, the paper information acquiring unit 11, the rendering engine 12, and the color toner region extracting unit 13 are individually provided. However, the invention is not limited thereto and the rendering engine 12 may include functions of the paper information acquiring unit 11 and/or the color toner region extracting unit 13.

Furthermore, in the above embodiment, the clear processing unit 18 determines regions (color toner regions) on which a glossy effect is given and a type of the glossy effect based on image data of a gloss control plate. However, the invention is not limited thereto. When paper information (glossiness) acquired by the paper information acquiring unit 11 and color toner region information extracted by the color toner region extracting unit 13 are directly input to the clear processing unit 18, the clear processing unit 18 may determine regions on which a glossy effect is given and a type of the glossy effect based on the input information.

Furthermore, in the first embodiment, the print control system includes the DFE 10, the MIC 20, the printer machine 30, the glosser 40, and the low-temperature fixing unit 50. However, the invention is not limited thereto. For example, the DFE 10, the MIC 20, and the printer machine 30 may be integrally formed to constitute one image forming apparatus. In addition, an image forming apparatus including the glosser 40 and the low-temperature fixing unit 50 may be constituted.

Furthermore, in the print control system according to the first embodiment, an image is formed by using toners of a plurality of colors of CMYK. However, an image may be formed by using toner of one color.

Moreover, in the first embodiment, various programs that are executed in the DFE 10 may be provided by being stored on a computer connected to a network such as the Internet and being loaded through the network. Alternatively, the programs may be provided as a computer program product by being recorded in a computer-readable recording medium, such as a CD-ROM, a flexible disk (FD), a CD-R, and a digital versatile disk (DVD), with a file in a format that can be installed or a format that can be executed.

Second Embodiment

In the first embodiment, the paper information acquiring unit 11, the rendering engine 12, and the color toner region extracting unit 13 are provided on the DFE 10 and the paper information acquiring process, the color toner region extracting process, the image data generating processing for the CMYK color plates and the gloss control plate are performed on the DFE 10. However, the invention is not limited thereto. Any of a plurality of processes that are performed on one apparatus may be performed on equal to or more than one other apparatuses connected to the one apparatus through a network.

Furthermore, when the above configuration in which "any of the processing is performed on equal to or more than one other apparatuses connected to the one apparatus through a network" is employed, the following processing is included. Data input/output processing between the one apparatus and the other apparatuses and between other apparatuses, such as processing of outputting data (information) generated in processing performed on the one apparatus from the one apparatus to another apparatus, and processing in which another apparatus inputs the data are included.

When the number of other apparatus is one, data input/output processing between the one apparatus and the other apparatus is included. On the other hand, when the number of other apparatuses is two or more, data input/output processing between the one apparatus and the other apparatuses and between other apparatuses like between a first other apparatus and a second other apparatus is included.

The following print control system according to the second embodiment is configured by mounting a part of the functions of the DFE on a server apparatus on a network.

Figure 10:
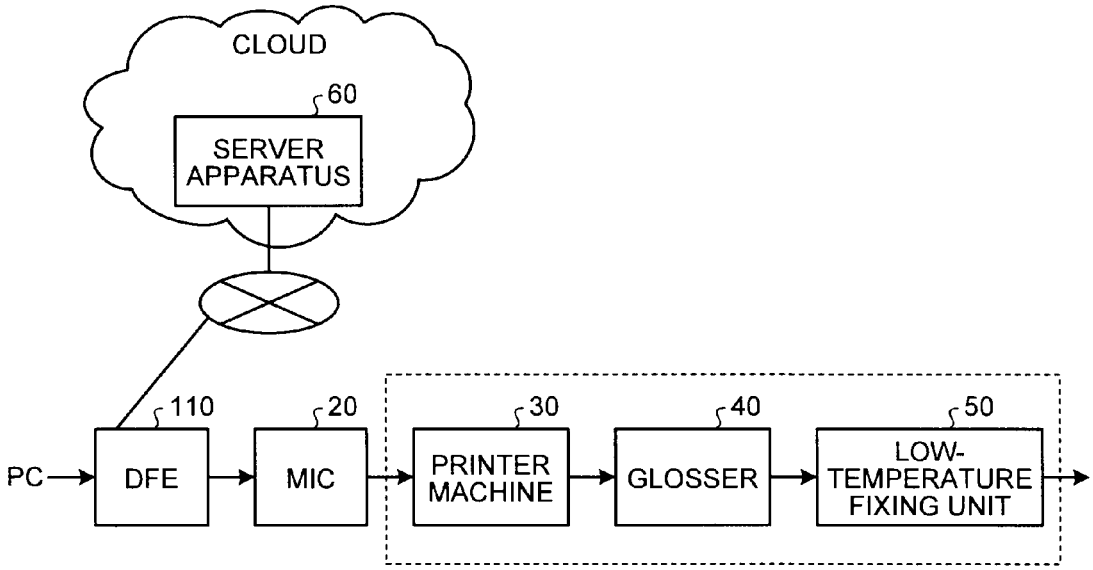
FIG. 10 is a diagram illustrating an example of a configuration of a print control system according to a second embodiment of the present invention.

FIG. 10 is a diagram illustrating an example of a configuration of the print control system according to the second embodiment. The print control system according to the second embodiment includes a DFE 110, the MIC 20, the printer machine 30, the glosser 40, the low-temperature fixing unit 50, and a server apparatus 60 in the cloud computing. Note that the glosser 40 and the low-temperature fixing unit 50 serve as post-processors.

In the second embodiment, the DFE 110 is connected to the single server apparatus 60 through a network (cloud) such as the Internet. Furthermore, in the second embodiment, the paper information acquiring unit, the rendering engine, and the color toner region extracting unit on the DFE 10 in the first embodiment are provided on the server apparatus 60. Therefore, in the second embodiment, the paper information acquiring process, the color toner region extracting process, and the image data generating processing for the CMYK color plates and the gloss control plate are performed on the server apparatus 60. Since functions and configurations of the MIC 20, the printer machine 30, the glosser 40, and the low-temperature fixing unit 50 are the same as those in the first embodiment, explanation thereof is not described.

The DFE 110 communicates with the printer machine 30 through the MIC 20 so as to control image formation on the printer machine 30. Furthermore, a PC is connected to the DFE 110. The DFE 110 receives image data from the PC and transmits the image data to the server apparatus 60. Thereafter, image data that has been generated on the server apparatus 60 and with which the printer machine 30 forms toner images corresponding to toners of CMYK and clear toner is transmitted to the printer machine 30 through the MIC 20. Details thereof will be described later.

The PC also performs operations that are the same as those in the first embodiment. If a user performs a predetermine operation when an image is output, the PC generates image data with an image processing application that has been previously installed and transmits the image data together with print setting data to the DFE 110 as print data.

Figure 11:
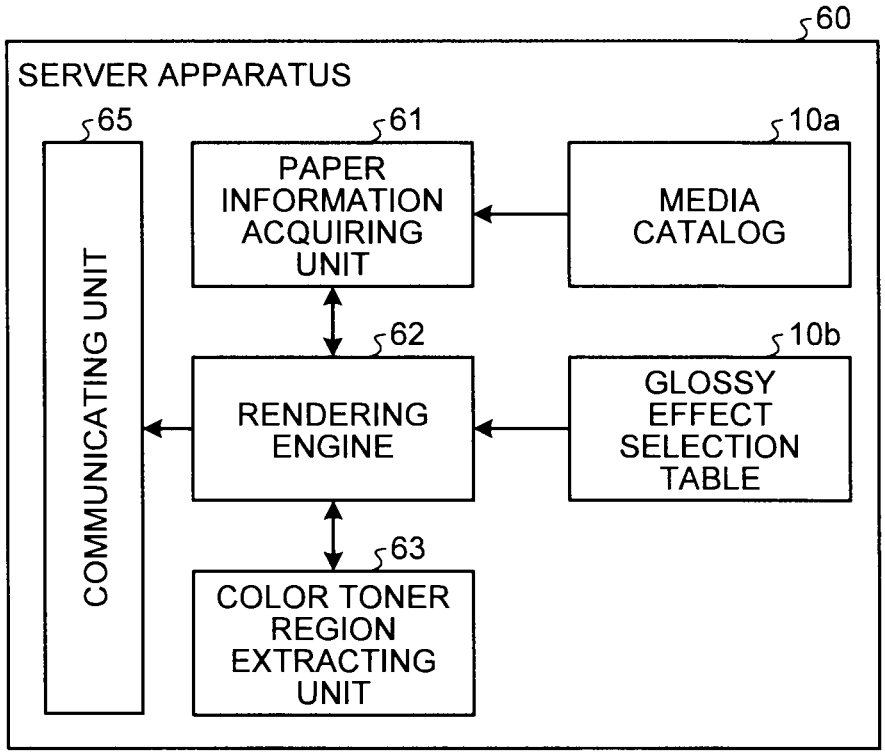
FIG. 11 is a diagram illustrating an example of a functional configuration of a server apparatus according to the second embodiment.

Next, the server apparatus 60 is described. FIG. 11 is a diagram illustrating an example of a functional configuration of a server apparatus according to the second embodiment. The server apparatus 60 includes, as a hardware configuration, a controller such as a CPU, a main storage unit such as a ROM and a RAM, and an auxiliary storage unit such as an HDD, and has a hardware configuration using a common computer (any of them are not illustrated). The controller controls the entire apparatus. The main storage unit stores various data and various programs. The auxiliary storage unit stores various data and various programs.

As illustrated in FIG. 11, the server apparatus 60 mainly includes the media catalog 10*a*, the glossy effect selection table 10*b*, a communicating unit 65, a paper information acquiring unit 61, a rendering engine 62, and a color toner region extracting unit 63. The communicating unit 65, the paper information acquiring unit 61, the rendering engine 62, and the color toner region extracting unit 63 are realized when the controller of the server apparatus 60 executes various programs stored in the main storage unit or the auxiliary storage unit.

The media catalog 10*a* and the glossy effect selection table 10*b* are stored in the auxiliary storage unit, for example. The media catalog 10*a* is the same as the media catalog 10*a* in the first embodiment as described with reference to FIG. 3. The glossy effect selection table 10*b* is the same as the glossy effect selection table 10*b* in the first embodiment as described with reference to FIG. 4.

The communicating unit 65 transmits/receives various data and requests to/from the DFE 110. To be more specific, the communicating unit 65 receives, from the DFE 110, print data including image data and print setting data and requests for generation of CMYK color plates and a gloss control plate. Furthermore, the communicating unit 65 transmits pieces of image data of the CMYK color plates and the gloss control plate that have been generated by the rendering engine 62, which will be described later, to the DFE 110.

The paper information acquiring unit 61 determines the paper type of paper as a print medium based on the print setting data included in the print data or the like and reads out paper information relating to the paper type from the media catalog 10*a*. In addition, the paper information acquiring unit 61 outputs the paper information that has been read out from the media catalog 10*a* to the rendering engine 62. A paper type determination method is not particularly limited and various methods can be used as in the first embodiment.

The image data included in the print data transmitted from the DFE 110, a glossiness which is a piece of paper information output from the paper information acquiring unit 61, and the color toner region information indicating color toner regions that have been extracted by the color toner region extracting unit 63 are input to the rendering engine 62.

The rendering engine 62 interprets the input image data and converts the image data expressed in a vector format to image data in a raster format. In addition, the rendering engine 62 converts a color space expressed in an RGB format to a color space in a CMYK format. With this, the rendering engine 62 generates pieces of 8-bit image data of the CMYK color plates. Then, the rendering engine 62 outputs the generated image data to the color toner region extracting unit 63 and the communicating unit 65.

Furthermore, the rendering engine 62 reads out density information (density value) corresponding to a glossiness included in the input paper information from the glossy effect selection table 10*b*. Then, the rendering engine 12 sets the density value that has been read out from the glossy effect selection table 10*b* as a pixel value for each pixel of color toner regions indicated by the color toner region information input from the color toner region extracting unit 63. With this, the rendering engine 62 generates 8-bit image data of the gloss control plate. Then, the rendering engine 62 outputs the image data of the gloss control plate to the communicating unit 65. The pieces of image data of the CMYK color plates and the gloss control plate are generated in the same manner as the first embodiment.

The color toner region extracting unit 63 extracts regions to which color toners adhere (color toner regions) with reference to the pieces of image data of the CMYK color plates that have been generated by the rendering engine 62. Furthermore, the color toner region extracting unit 63 determines whether the size of a pixel group (cluster) constituting each color toner region is equal to or larger than a previously set threshold. If the size of the pixel group is smaller than the threshold, the color toner region extracting unit 63 excludes the group from the color toner regions. Subsequently, the color toner region extracting unit 63 generates color toner region information indicating positions of the color toner regions in a page, that is, positions of the pixel groups constituting the color toner regions, and outputs the generated color toner region information to the rendering engine 62. Operations of the color toner region extracting unit 63 are the same as those in the first embodiment (see FIGS. 5A and 5B).

Figure 12:
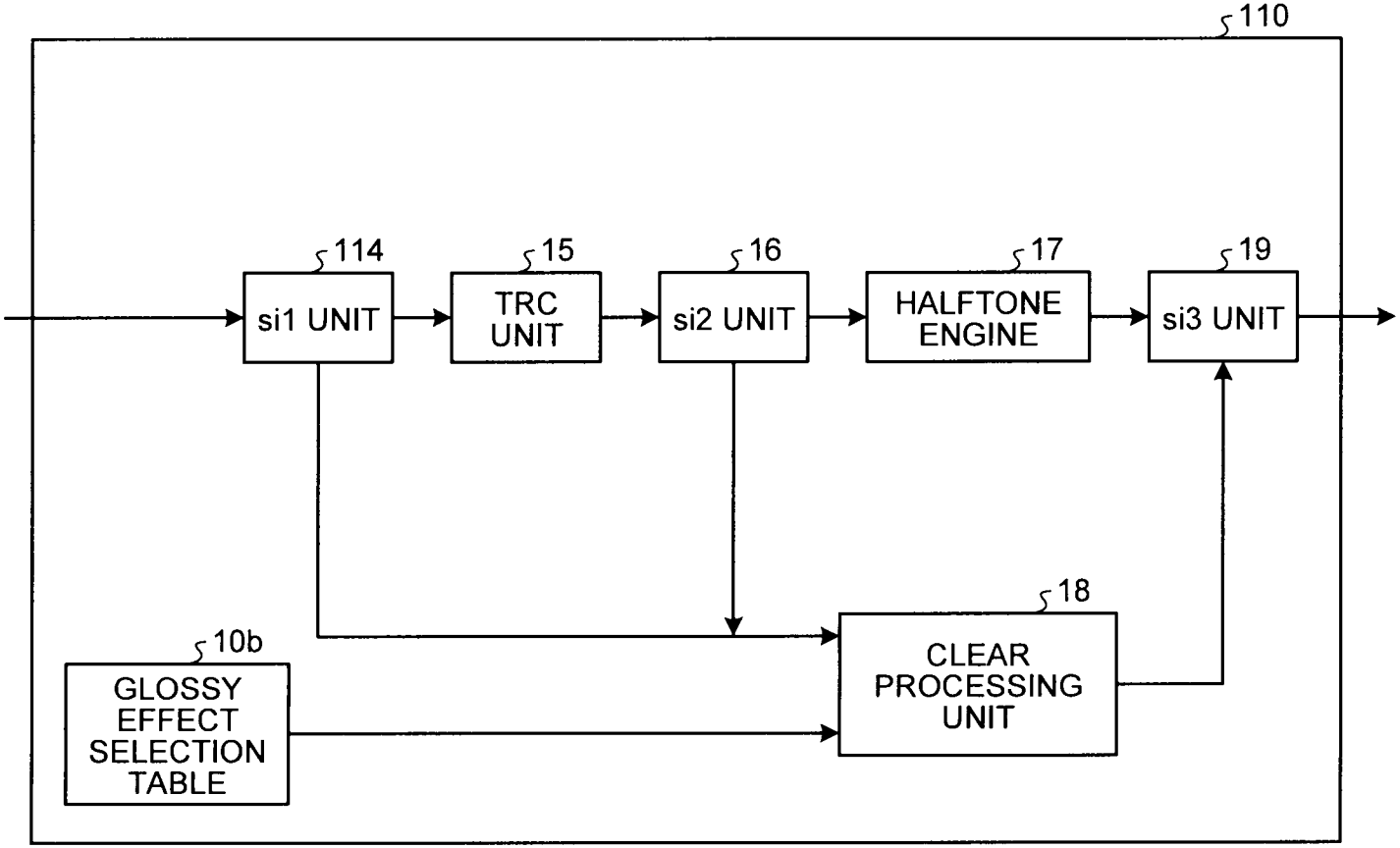
FIG. 12 is a diagram illustrating an example of a functional configuration of a DFE according to the second embodiment.

Next, the DFE 110 is described. FIG. 12 is a diagram illustrating an example of a functional configuration of the DFE in the second embodiment. The DFE 110 includes, as a hardware configuration, a controller such as a CPU, a main storage unit such as a ROM and a RAM, and an auxiliary storage unit such as an HDD, and has a hardware configuration using a common computer (any of them are not illustrated). The controller controls the entire apparatus. The main storage unit stores various data and various programs. The auxiliary storage unit stores various data and various programs.

The DFE 110 according to the embodiment mainly includes a si1 unit 114, the TRC unit 15, the si2 unit 16, the halftone engine 17, the clear processing unit 18, the si3 unit 19, and the glossy effect selection table 10*b*. The si1 unit 114, the TRC unit 15, the si2 unit 16, the halftone engine 17, the clear processing unit 18, and the si3 unit 19 are realized when the controller of the DFE 110 executes various programs stored in the main storage unit or the auxiliary storage unit.

The glossy effect selection table 10*b* is stored in the auxiliary storage unit, for example. The glossy effect selection table 10*b* is the same as the glossy effect selection table 10*b* in the first embodiment as described with reference to FIG. 4. Functions and configurations of the TRC unit 15, the si2 unit 16, the halftone engine 17, the clear processing unit 18, and the si3 unit 19 are the same as those in the DFE 10 according to the first embodiment.

The si1 unit 114 transmits the print data including image data and print setting data that has been transmitted from the PC and requests for generation of CMYK color plates and a gloss control plate to the server apparatus 60. Furthermore, the si1 unit 114 receives pieces of image data of the CMYK color plates and the gloss control plate that have been generated on the server apparatus 60 from the server apparatus 60.

Figure 13:
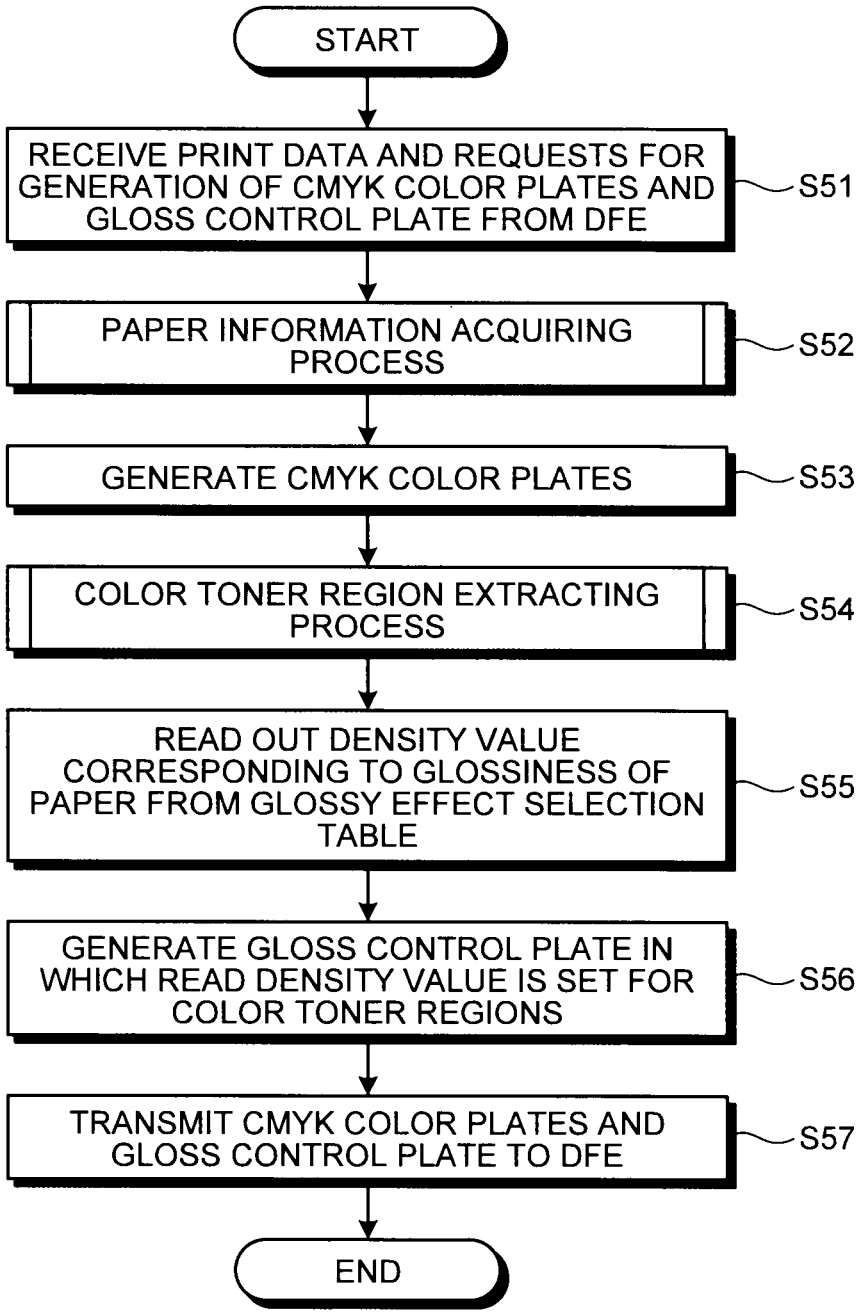
FIG. 13 is a flowchart illustrating procedures of glossy effect control process that is performed by the server apparatus according to the second embodiment.
Figure 14:
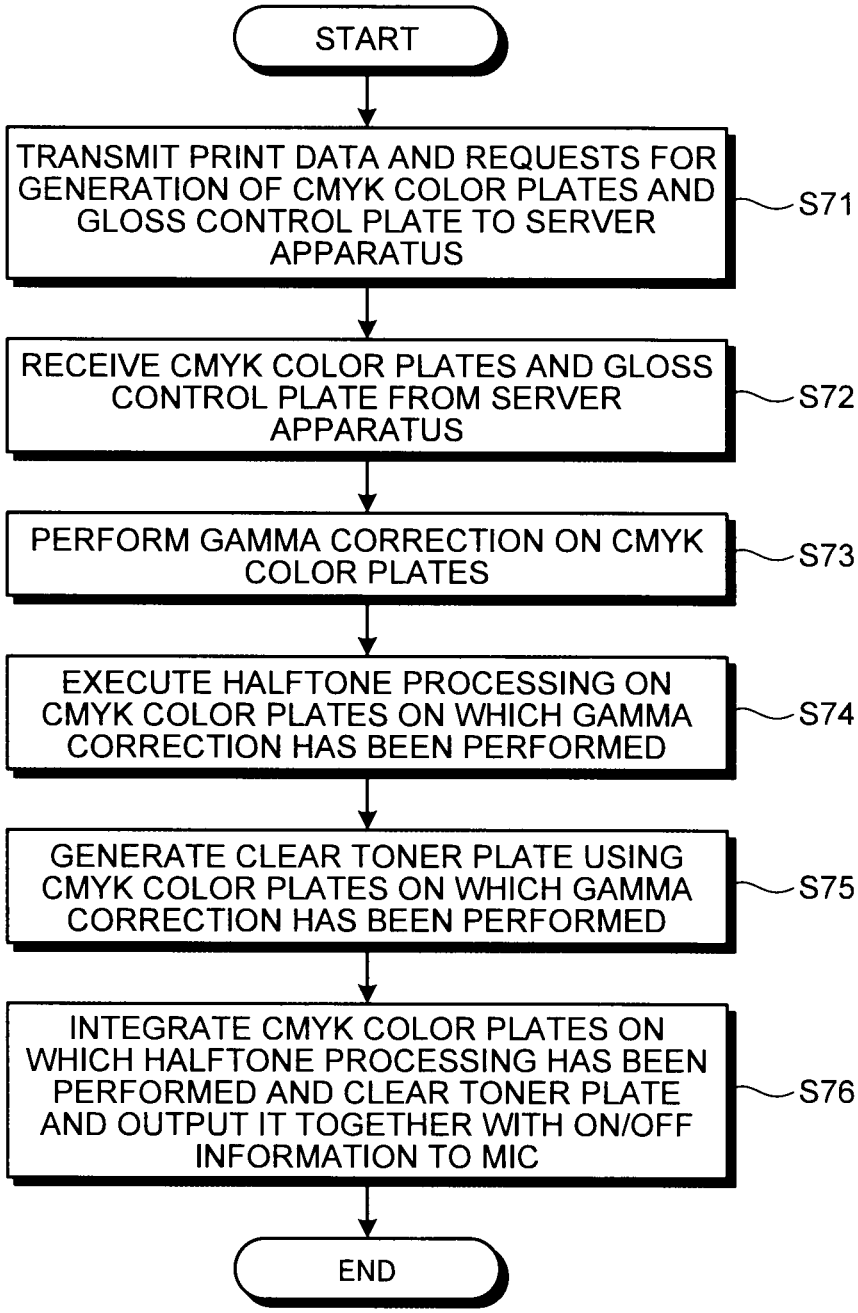
FIG. 14 is a flowchart illustrating procedures of glossy effect control process that is performed by the DFE according to the second embodiment.

Next, procedures of glossy effect control process that is performed by the print control system according to the second embodiment are described with reference to FIGS. 13 and 14. At first, processing that is performed on the server apparatus 60 is described. FIG. 13 is a flowchart illustrating the procedures of the glossy effect control process that is performed by the server apparatus according to the second embodiment.

At first, the communicating unit 65 receives print data and requests for generation of CMYK color plates and a gloss control plate from the DFE 110 (Step S51). The paper information acquiring unit 61 executes paper information acquiring process based on the received print data (including print setting data) (Step S52). Since the procedures of the paper information acquiring process are the same as the procedures in FIG. 8 in the first embodiment, explanation thereof is not described.

Next, if the rendering engine 62 receives the print data including the image data by the communicating unit 65, the rendering engine 62 generates pieces of 8-bit image data of CMYK color plates from the received image data and outputs the generated image data to the communicating unit 65 and the color toner region extracting unit 63 (Step S53).

Subsequently, the color toner region extracting unit 63 executes color toner region extracting process of extracting color toner regions from the pieces of image data of the CMYK color plates that have been generated at Step S53 (Step S54). Since the procedures of the color toner region extracting process are the same as the procedures in FIG. 9 in the first embodiment, explanation thereof is not described.

Then, if the rendering engine 62 receives input of the color toner region information from the color toner region extracting unit 63, the rendering engine 62 reads out a density value corresponding to a glossiness included in the paper information acquired in the paper information acquiring process at Step S52 from the glossy effect selection table 10*b* (Step S55). Subsequently, the rendering engine 62 generates 8-bit image data of the gloss control plate in which the density value read out at Step S55 is set as a pixel value for each pixel of the color toner regions indicated by the color toner region information and outputs the image data to the communicating unit 65 (Step S56).

Then, the communicating unit 65 transmits the pieces of image data of the CMYK color plates and the image data of the gloss control plate that have been output from the rendering engine 62, to the DFE 110 (Step S57).

Next, processing that is performed on the DFE 110 is described. FIG. 14 is a flowchart illustrating the procedures of the glossy effect control process that is performed by the DFE according to the second embodiment.

If the print data is input from the PC to the si1 unit 114, the si1 unit 114 transmits the print data and requests for generation of the CMYK color plates and the gloss control plate to the server apparatus 60 (Step S71). Thereafter, the si1 unit 114 receives the pieces of image data of the CMYK color plates and the image data of the gloss control plate that have been generated on the server apparatus 60 from the server apparatus 60 (Step S72). Then, the si1 unit 114 outputs the pieces of image data of the CMYK color plates to the TRC unit 15, and outputs the image data of the gloss control plate to the clear processing unit 18.

If the TRC unit 15 receives the pieces of 8-bit image data of the CMYK color plates through the si1 unit 114, the TRC unit 15 performs gamma correction with a gamma curve of 1D_LUT that is generated by calibration on the pieces of 8-bit image data of the CMYK color plates and outputs them to the si2 unit 16 (Step S73).

If the halftone engine 17 receives the pieces of image data of the CMYK color plates after the gamma correction through the si2 unit 16, the halftone engine 17 performs halftone processing of converting a data format of the pieces of 8-bit image data of the CMYK color plates to a data format of pieces of 2-bit image data of the CMYK color plates in order to output the image data to the printer machine 30 so as to acquire the pieces of 2-bit image data of the CMYK color plates after the halftone processing (Step S74).

Furthermore, the clear processing unit 18 determines a glossy effect corresponding to the pixel value (density value) set for each pixel of the input image data of the gloss control plate with reference to the above-mentioned glossy effect selection table 10*b*. The clear processing unit 18 makes such determination for all the pixels constituting the image data of the gloss control plate. It is to be noted that on the image data of the gloss control plate, since all the pixels constituting regions on which a glossy effect is given basically have the same density value, the same glossy effect is determined to be given to the pixels to which the same density value is set. In this manner, the clear processing unit 18 determines regions (color toner regions) on which a glossy effect is given and a type of the glossy effect to be given to the regions. Then, the clear processing unit 18 determines on/off of the glosser 40 in accordance with the determination of the regions and the type of the glossy effect, and appropriately generates 2-bit image data of the clear toner plate for causing the clear toner to adhere by appropriately using the pieces of 8-bit image data of the CMYK color plates after the gamma correction (Step S75).

Then, the si3 unit 19 integrates the pieces of 2-bit image data of the CMYK color plates after the halftone processing that have been obtained at Step S74 and the 2-bit image data of the clear toner plate that has been appropriately generated at Step S75, and outputs the integrated image data and the on/off information indicating on/off of the glosser 40 that has been determined at Step S75 to the MIC 20 (Step S76). Note that when the image data of the clear toner plate is not generated at Step S75, only the pieces of 2-bit image data of the CMYK color plates after the halftone processing that have been obtained at Step S74 are integrated and the integrated image data is output to the MIC 20 at Step S76.

As described above, in the second embodiment, the paper information acquiring process, the color toner region extracting process, and the generation of the pieces of image data of the CMYK color plates and the gloss control plate are performed on the server apparatus 60 in the cloud. Therefore, in the second embodiment, the following effect can be obtained in addition to the effects obtained in the first embodiment. Even when there are a plurality of host apparatuses (PC) or DFEs 110, the media catalog and the glossy effect selection table can be collectively changed, for example, which is convenient for a manager.

In the second embodiment, the paper information acquiring unit 61, the rendering engine 62, and the color toner region extracting unit 63 are provided on the single server apparatus 60 in the cloud and the paper information acquiring process, the color toner region extracting process, and the generation processing of the pieces of image data of the CMYK color plates and the gloss control plate are performed on the server apparatus 60. However, the invention is not limited thereto.

Figure 15:
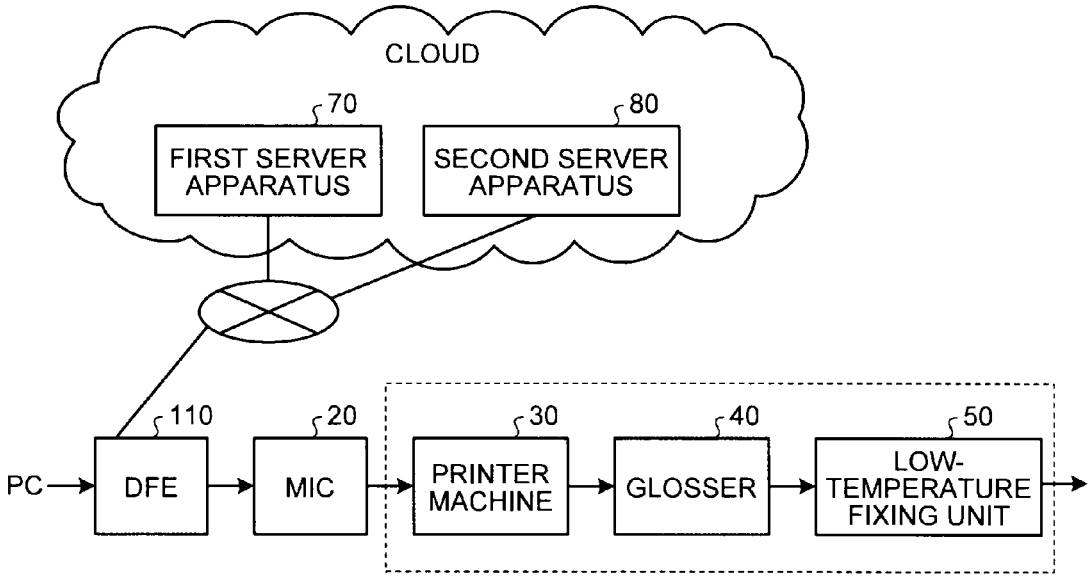
FIG. 15 is a network configuration diagram in which two servers are provided in the cloud computing.

For example, a configuration in which equal to or more than two server apparatuses are provided in the cloud and the above processing are executed by equal to or more than two server apparatuses in a distributed manner may be employed. FIG. 15 is a network configuration diagram in which two servers (first server apparatus 70 and second server apparatus 80) are provided in the cloud. In an example as illustrated in FIG. 15, the paper information acquiring process, the color toner region extracting process, and the generation of the pieces of image data of the CMYK color plates and the gloss control plate are performed on the first server apparatus 70 and the second server apparatus 80 in a distributed manner.

Furthermore, in the second embodiment, the paper information acquiring process, the color toner region extracting process, and the generation processing of the pieces of image data of the CMYK color plates and the gloss control plate are performed on the server apparatus 60 in the cloud. However, the gamma correction by the TRC unit 15, the halftone processing by the halftone engine 17, and the generation processing of the image data of the clear toner plate by the clear processing unit 18 may be executed on one server apparatus or equal to or more than two server apparatuses.

Furthermore, any one of, a plurality of, or all of the processing among the paper information acquiring process, the color toner region extracting process, the generation processing of the pieces of image data of the CMYK color plates and the gloss control plate, the gamma correction by the TRC unit 15, the halftone processing by the halftone engine 17, and the generation processing of the image data of the clear toner plate by the clear processing unit 18 may be executed on one server apparatus or equal to or more than two server apparatuses.

In addition, in the second embodiment, the paper information acquiring process, the color toner region extracting process, and the generation process of the pieces of image data of the CMYK color plates and the gloss control plate are performed on the server apparatus 60 in the cloud. However, these processes may be executed on a PC (host apparatus). Furthermore, any one of or a plurality of processes among the paper information acquiring process, the color toner region extracting process, the generation process of the pieces of image data of the CMYK color plates and the gloss control plate, the gamma correction by the TRC unit 15, the halftone processing by the halftone engine 17, and the generation processing of the image data of the clear toner plate by the clear processing unit 18 may be executed on a PC (host apparatus).

According to the embodiments, a glossy effect for providing a glossiness equivalent to a glossiness of paper can be given to a region to which color toner adheres. Therefore, a glossy effect obtained on the region to which the color toner adheres can be made equivalent to a glossy effect of the paper itself.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A print control apparatus comprising:

an acquiring unit configured to acquire a glossiness indicating a degree of glossy effect on a recording medium;

a first generating unit configured to generate image data based on the glossiness acquired by the acquiring unit; and an output unit configured to output the image data, wherein:

the print control apparatus is connected to an image forming apparatus that includes color toner and colorless clear toner, the image forming apparatus forming an image on the recording medium based on color plate data for making the color toner adhere and clear toner plate data for making the clear toner adhere, the first generating unit generates the clear toner plate data as the image data based on the color plate data, and the clear toner plate data defines an adhesion amount of the color toner and an adhesion amount of the clear toner that give a glossy effect with a glossiness equivalent to the glossiness of the recording medium, wherein the print control apparatus further comprises:

an extracting unit configured to extract a color toner region to which the color toner is to adhere on the recording medium, from the color plate data, wherein the first generating unit generates the clear toner plate data for the color toner region based on the color plate data, and wherein the extracting unit excludes, from a result of extraction, a color toner region having a size smaller than a predetermined threshold among the extracted color toner regions.

2. The print control apparatus according to claim 1, further comprising a post-processing control unit configured to control operation of the post-processor depending on the glossy effect.

3. The print control apparatus according to claim 2, further comprising a second generating unit configured to generate gloss control plate data that indicates the color toner region extracted by the extracting unit and a type of the glossy effect for the color toner region with the glossiness equivalent to the glossiness of the recording medium, wherein the first generating unit generates the clear toner plate data based on the color toner region and the type of the glossy effect for the color toner region that are indicated by the gloss control plate data, and the post-processing control unit controls the operation of the post-processor depending on the glossy effect for the color toner region indicated by the gloss control plate data.

4. The print control apparatus according to claim 3, wherein the second generating unit generates the gloss control plate data in which a predetermined density value indicating the type of the glossy effect is set as a pixel value of each pixel of the color toner region.

5. The print control apparatus according to claim 3, wherein a glosser configured to pressurize at a high temperature and a high pressure as the post-processor is connected to the image forming apparatus, the type of the glossy effect includes a glossy effect, the first generating unit generates first clear toner plate data used in the image forming apparatus so that densities of pixels indicated in the color plate data are smoothed if the gloss control plate data indicates the glossy effect, and the post-processing control unit turns the glosser on if the glossy effect indicates a second gloss having a glossiness larger than that of a first gloss for giving normal gloss.

6. The print control apparatus according to claim 3, wherein a low-temperature fixing unit configured to fix the clear toner at a temperature lower than a fixing temperature used in the image forming apparatus is connected to the image forming apparatus, the type of the glossy effect includes a glossy effect, the first generating unit generates first clear toner plate data used in the image forming apparatus or second clear toner plate data used in the low-temperature fixing unit, using a predetermined pattern, and the output unit outputs the second clear toner plate data to the low-temperature fixing unit if the glossy effect indicates a fourth gloss having a glossiness smaller than that of a third gloss for reducing normal gloss.

7. The print control apparatus according to claim 6, wherein the predetermined pattern is a halftone pattern if the glossy effect indicates the third gloss, and the predetermined pattern is a solid mask pattern if the glossy effect indicates the fourth gloss.

8. A print control system comprising the print control apparatus according to claim 1.

9. The print control system according to claim 8, further comprising an image forming apparatus that includes color toner and colorless clear toner, the image forming apparatus forming an image on the recording medium based on color plate data for making the color toner adhere and clear toner plate data for making the clear toner adhere, wherein the first generating unit generates the clear toner plate data as the image data based on the color plate data, and the clear toner plate data defines an adhesion amount of the color toner and an adhesion amount of the clear toner that give a glossy effect with a glossiness equivalent to the glossiness of the recording medium.

10. The print control system according to claim 9, further comprising an extracting unit configured to extract a color toner region to which the color toner is to adhere on the recording medium, from the color plate data, wherein the first generating unit generates the clear toner plate data for the color toner region based on the color plate data.

11. The print control system according to claim 10, further comprising a post-processing control unit configured to control operation of the post-processor depending on the glossy effect.

12. The print control system according to claim 11, wherein the extracting unit excludes, from a result of extraction, a color toner region having a size smaller than a predetermined threshold among the extracted color toner regions.

13. The print control system according to claim 11, further comprising a second generating unit configured to generate gloss control plate data that indicates the color toner region extracted by the extracting unit and a type of the glossy effect for the color toner region with the glossiness equivalent to the glossiness of the recording medium, wherein the first generating unit generates the clear toner plate data based on the color toner region and the type of the glossy effect for the color toner region that are indicated by the gloss control plate data, and the post-processing control unit controls the operation of the post-processor depending on the glossy effect for the color toner region indicated by the gloss control plate data.

14. The print control system according to claim 13, wherein the second generating unit generates the gloss control plate data in which a predetermined density value indicating the type of the glossy effect is set as a pixel value of each pixel of the color toner region.

15. A print control method comprising:

acquiring a glossiness of a recording medium;

determining a plurality of image regions to be formed on the recording medium, generating image data for colored toner to be applied to the image regions;

generating data defining at least one clear toner region which increases the glossiness of the colored toner to match the glossiness which has been acquired, wherein the generating of the data defining the at least one clear toner region is performed by excluding the image regions below a predetermined size;

forming the image regions by applying colored toner using the image data for colored toner which has been generated; and forming the at least one clear toner region by applying clear toner using the data defining the at least one clear toner region which increases the glossiness of the colored toner to match the glossiness which has been acquired.

16. A computer program product comprising a non-transitory computer readable medium including programmed instructions, wherein the instructions cause a computer included in a print control apparatus to execute:

acquiring a glossiness of a recording medium;

determining a plurality of image regions to be formed on the recording medium, generating image data for colored toner to be applied to the image regions;

generating data defining at least one clear toner region which increases the glossiness of the colored toner to match the glossiness which has been acquired, wherein the generating of the data defining the at least one clear toner region is performed by excluding the image regions below a predetermined size;

forming the image regions by applying colored toner using the image data for colored toner which has been generated; and forming the at least one clear toner region by applying clear toner using the data defining the at least one clear toner region which increases the glossiness of the colored toner to match the glossiness which has been acquired.

* * * * *